US010726807B2

(12) United States Patent
Liao et al.

(10) Patent No.: US 10,726,807 B2
(45) Date of Patent: Jul. 28, 2020

(54) DISPLAY APPARATUS

(71) Applicant: Au Optronics Corporation, Hsinchu (TW)

(72) Inventors: Wei-Chien Liao, Hsinchu (TW); Meng-Chieh Tsai, New Taipei (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/200,539

(22) Filed: Nov. 26, 2018

(65) Prior Publication Data

US 2020/0111442 A1 Apr. 9, 2020

(30) Foreign Application Priority Data

Oct. 9, 2018 (TW) ..... 107135660 A

(51) Int. Cl.
*G09G 5/00* (2006.01)

(52) U.S. Cl.
CPC ..... *G09G 5/003* (2013.01); *G09G 2310/0251* (2013.01); *G09G 2310/0254* (2013.01); *G09G 2310/08* (2013.01); *G09G 2320/0252* (2013.01); *G09G 2320/0606* (2013.01); *G09G 2320/068* (2013.01); *G09G 2330/028* (2013.01); *G09G 2354/00* (2013.01)

(58) Field of Classification Search
CPC ..... G09G 5/003; G09G 2310/0254; G09G 2320/068; G09G 2330/028
See application file for complete search history.

(56) References Cited

U.S. PATENT DOCUMENTS

2011/0102404 A1 5/2011 Hou
2011/0249210 A1* 10/2011 Yun ..... G02F 1/134363 349/41
2012/0113083 A1* 5/2012 Kim ..... G09G 3/344 345/212
2012/0113084 A1 5/2012 Yang et al.
2012/0274624 A1* 11/2012 Lee ..... G09G 3/3648 345/213
2014/0252964 A1* 9/2014 Wu ..... H03K 19/0175 315/161

(Continued)

FOREIGN PATENT DOCUMENTS

CN 108630161 10/2018
TW 201108191 3/2011
TW 201220273 5/2012

*Primary Examiner* — Michael Pervan
(74) *Attorney, Agent, or Firm* — JCIPRNET

(57) ABSTRACT

A display apparatus including a display panel and a plurality of common voltage generators is provided. The display panel has a plurality of pixel regions. The plurality of common voltage generators are coupled to the plurality of pixel regions respectively and generate a plurality of common voltages, wherein each of the plurality of common voltage generators respectively maintains each of the plurality of common voltages at a first voltage, a second voltage, and a third voltage in a plurality of first timing periods in a first polarity period and respectively maintains each of the plurality of common voltages at a fifth voltage, a fourth voltage, and the third voltage in a plurality of second timing periods in a second polarity period in a narrow view mode, wherein the first voltage>the second voltage>the third voltage>the fourth voltage>the fifth voltage.

16 Claims, 11 Drawing Sheets

(56) References Cited

U.S. PATENT DOCUMENTS

| | | | | |
|---|---|---|---|---|
| 2017/0263208 | A1* | 9/2017 | Imai | G09G 3/342 |
| 2017/0345386 | A1* | 11/2017 | Seo | G09G 3/3611 |
| 2019/0050093 | A1* | 2/2019 | Li | G09G 3/3611 |
| 2019/0180710 | A1* | 6/2019 | Kim | G09G 3/3685 |

* cited by examiner

DISPLAY APPARATUS

CROSS REFERENCE TO RELATED APPLICATION

This application claims the priority benefit of Taiwan application serial no. 107135660, filed on Oct. 9, 2018. The entirety of the above-mentioned patent application is hereby incorporated by reference herein and made a part of specification.

BACKGROUND OF THE INVENTION

Field of the Invention

The invention relates to a display apparatus, and particularly relates to a display apparatus with a narrow view mode.

Description of Related Art

In a viewing angle control technique of today's display apparatus, the display apparatus may be operated in a narrow view mode of a narrow view angle, and when a user views a display panel from a lateral view angle, the user may only see an all-white display image, so as to achieve a peep preventing effect. However, regarding some specific products, such as an Automatic Teller Machine (ATM), etc., a manufacturer thereof does not like the image whitening effect. Therefore, if the narrow view mode of the display apparatus only has the image whitening effect in setting, commercial application thereof is rather limited.

SUMMARY OF THE INVENTION

The invention is directed to a display apparatus, which is adapted to simplify generating circuits of common voltages, and under a narrow view mode, a display panel has a display image blackening effect.

The invention provides a display apparatus including a display panel and a plurality of common voltage generators. The display panel has a plurality of pixel regions. The plurality of common voltage generators are coupled to the plurality of pixel regions respectively and generate a plurality of common voltages respectively, wherein each of the plurality of common voltage generators respectively maintains each of the plurality of common voltages at a first voltage, a second voltage, and a third voltage in a plurality of first time intervals in a first polarity driving period, and respectively maintains each of the plurality of common voltages at a fifth voltage, a fourth voltage, and the third voltage in a plurality of second time intervals in a second polarity driving period in a narrow view mode, wherein the first voltage>the second voltage>the third voltage>the fourth voltage>the fifth voltage.

Based on the above description, the plurality of common voltage generators are respectively used for providing the plurality of common voltages to the plurality of pixel regions in the display panel, so that each of the common voltage generators respectively maintains each of the common voltages at five different voltages in different time intervals in the first polarity driving period and the second polarity driving period in the narrow view mode of the display apparatus. In this way, the display panel produces an all-black display image, so as to achieve the effect that the display apparatus has the display image blackening function.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
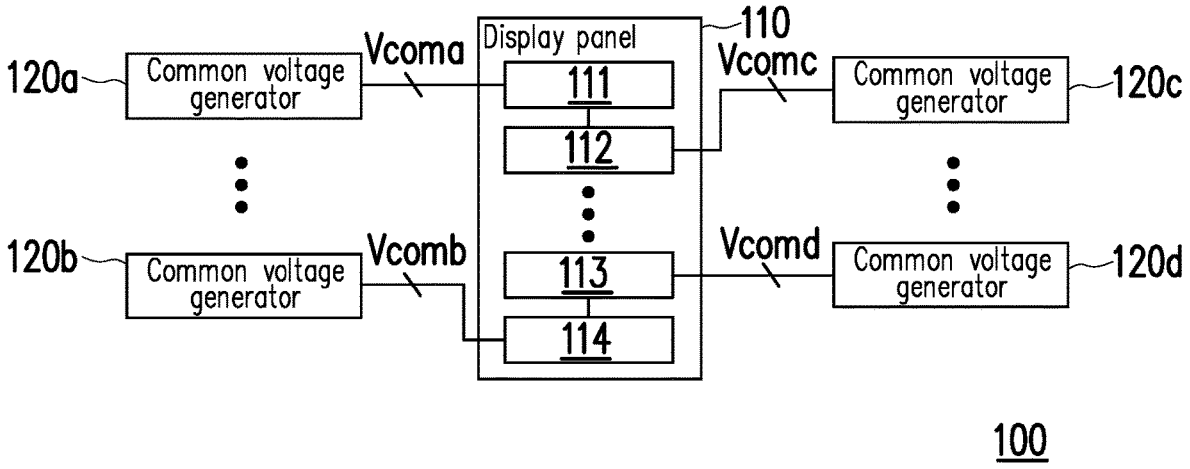
FIG. 1A is a schematic diagram of a display apparatus according to an embodiment of the invention.

Referring to FIG. 1A, FIG. 1A is a schematic diagram of a display apparatus according to an embodiment of the invention. The display apparatus 100 includes a display panel 110 and a plurality of common voltage generators (for example, common voltage generators 120*a*, 120*b*, 120*c* and 120*d*). The display panel 110 has a plurality of pixel regions (for example pixel regions 111, 112, 113 and 114). The common voltage generators 120*a*, 120*b*, 120*c* and 120*d* are coupled to the pixel regions 111, 112, 113 and 114 respectively, where the common voltage generator 120*a* is coupled to the pixel region 111, the common voltage generator 120*b* is coupled to the pixel region 114, the common voltage generator 120*c* is coupled to the pixel region 112, and the common voltage generator 120*d* is coupled to the pixel region 113.

Moreover, the common voltage generators 120*a*, 120*b*, 120*c* and 120*d* respectively generate a plurality of common voltages (for example, common voltages Vcoma, Vcomb, Vcomc and Vcomd), such that the common voltage generator 120*a* provides the common voltage Vcoma to the pixel region 111, the common voltage generator 120*b* provides the common voltage Vcomba to the pixel region 114, the common voltage generator 120*c* provides the common voltage Vcomc to the pixel region 112, and the common voltage generator 120*d* provides the common voltage Vcomd to the pixel region 113. It should be noted that for simplicity's sake, only four common voltage generators and four pixel regions are illustrated in FIG. 1A to serve as an exemplary embodiment, though the number of the common voltage generators and the number of the corresponding pixel regions are not limited by the invention.

Figure 1B:
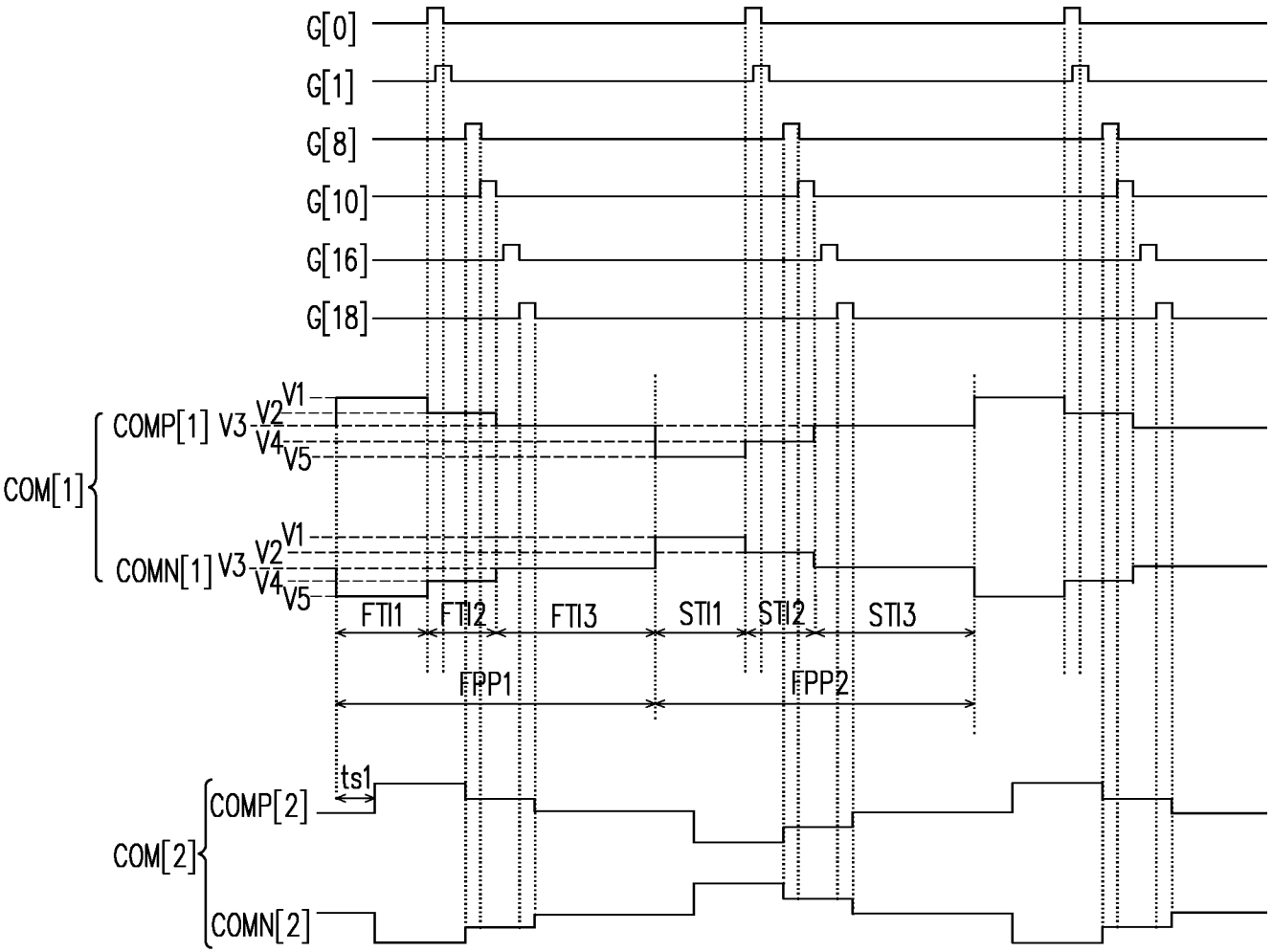
FIG. 1B is a signal waveform schematic diagram of the display apparatus of FIG. 1 in a narrow view mode.

Then, referring to FIG. 1A and FIG. 1B, FIG. 1B is a signal waveform schematic diagram of the display apparatus of FIG. 1 in a narrow view mode. In the embodiment, the common voltages Vcoma, Vcomb, Vcomc and Vcomd include a plurality of common voltage pairs (for example, common voltage pairs COM[1], COM[2] of FIG. 1B), for example, the common voltage Vcoma includes the common voltage pair COM[1], and the common voltage Vcomc includes the common voltage pair COM[2]. Moreover, each of the common voltage pairs includes a first common voltage and a second common voltage, where the first common voltage and the second common voltage are complementary. For example, the common voltage pair COM[1] includes a common voltage COMP[1] and a common voltage COMN[1], where the common voltage COMP[1] and the common voltage COMN[1] are complementary, and the common voltage pair COM[2] includes a common voltage COMP[2] and a common voltage COMN[2], where the common voltage COMP[2] and the common voltage COMN[2] are complementary. It should be noted that for simplicity's sake, only two common voltage pairs and 0-18$^{th}$ pixels are illustrated in FIG. 1B to serve as an exemplary embodiment, though the invention is not limited thereto.

Further, when the display apparatus is operated in the narrow view mode, each of the common voltage generators 120*a*, 120*b*, 120*c* and 120*d* respectively maintains each of the common voltages COMP[1], COMN[1], COMP[2] and COMN[2] at a first voltage V1, a second voltage V2, and a third voltage V3 in a plurality of first time intervals (for example, time intervals FTI1, FTI2, FTI3) in a first polarity driving period FPP1, and respectively maintains each of the common voltages COMP[1], COMN[1], COMP[2] and COMN[2] at a fifth voltage V5, a fourth voltage V4, and the third voltage V3 in a plurality of second time intervals (for example, time intervals STI1, STI2, STI3) in a second polarity driving period FPP2. It should be noted that in the embodiment, the first voltage V1>the second voltage V2>the third voltage V3>the fourth voltage V4>the fifth voltage V5, and an absolute value of the first voltage V1 is equal to an absolute value of the fifth voltage V5, and an absolute value of the second voltage V2 is equal to an absolute value of the fourth voltage V4.

In other words, in the embodiment, the first polarity driving period FPP1 includes a plurality of time intervals FTI1, FTI2 and FTI3, and the second polarity driving period FPP2 after the first polarity driving period FPP1 includes a plurality of time intervals STI1, STI2 and STI3. The common voltage COMP[1] in the common voltage pair COM[1] is maintained to the first voltage V1 in the time interval FTI1 in the first polarity driving period FPP1. In the time interval FTI2 after the time interval FTI1, the common voltage COMP[1] is maintained to the second voltage V2. In the time interval FTI3 after the time interval FTI2, the common voltage COMP[1] is maintained to the third voltage V3. Then, in the second polarity driving period FPP2 after the first polarity driving period FPP1, and in the time interval STI1, the common voltage COMP[1] is maintained to the fifth voltage V5. In the time interval STI2 after the time interval STI1, the common voltage COMP[1] is maintained to the fourth voltage V4. In the time interval STI3 after the time interval STI2, the common voltage COMP[1] is maintained to the third voltage V3, where the third voltage V3 is, for example, a zero voltage, though the invention is not limited thereto.

It should be noted that since the common voltage COMP[1] and the common voltage COMN[1] are complementary, i.e. in the first polarity driving period FPP1, when the common voltage COMP[1] is the first voltage V1, the common voltage COMN[1] is the fifth voltage V5, and when the common voltage COMP[1] is the second voltage V2, the common voltage COMN[1] is the fourth voltage V4, and when the common voltage COMP[1] is the third voltage V3, the common voltage COMN[1] is also the third voltage V3. Comparatively, in the second polarity driving period FPP2, when the common voltage COMP[1] is the fifth voltage V5, the common voltage COMN[1] is the first voltage V1, and when the common voltage COMP[1] is the fourth voltage V4, the common voltage COMN[1] is the second voltage V2, and when the common voltage COMP[1] is the third voltage V3, the common voltage COMN[1] is also the third voltage V3. It should be noted that signal waveforms and voltage magnitudes of the common voltage COMP[2] and the common voltage COMN[2] in the common voltage pair COM[2] in each of the time intervals in each of the polarity driving periods are similar to that of the common voltage COMP[1] and the common voltage COMN[1] in the common voltage pair COM[1], so that details thereof are not repeated.

Moreover, it should be noted that the adjacent common voltages in the embodiment have a time shift there between. For example, the common voltage COMP[1] and the common voltage COMN[1] in the common voltage pair COM[1] and the common voltage COMP[2] and the common voltage COMN[2] in the common voltage pair COM[2] have a time shift ts1 there between. Similarly, the common voltage COMP[2] and the common voltage COMN[2] in the common voltage pair COM[2] and a first common voltage and a second common voltage in a next adjacent common voltage pair may also have the time shift ts1 there between, and the others are deduced by analogy. It should be noted that in the embodiment, the common voltage pair COM[1] is provided to the corresponding pixel region (for example, the pixel region 111), and the common voltage pair COM[2] is provided to the corresponding pixel region (for example, the pixel region 112), though the invention is not limited thereto.

In this way, each of the common voltage generators 120*a*, 120*b*, 120*c*, 120*d* of the embodiment may sequentially provide each of the common voltages with five different voltage magnitudes in different time intervals to each of the corresponding pixel regions 111, 112, 113, 114, so that the display apparatus may produce an all-black display image in the narrow view mode, so as to achieve the effect that the display apparatus has the display image blackening function.

On the other hand, in the narrow view mode, when each of the common voltages (i.e. the common voltages COMP[1], COMN[1], COMP[2], COMN[2]) is equal to the second voltage V2, and when each of the common voltages COMP[1], COMN[1], COMP[2], COMN[2] is equal to the fourth voltage V4, the pixel region corresponding to each of the common voltages COMP[1], COMN[1], COMP[2], COMN[2] executes a data writing operation. For example, when the common voltage COMP[1] is equal to the second voltage V2, the common voltage COMN[1] is now equal to the fourth voltage V4, and the pixel region 111 corresponding to the common voltage COMP[1] and the common voltage COMN[1] may execute the data writing operation, i.e. a plurality of pixels in the pixel region 111 may receive corresponding gate driving signals (i.e. gate driving signals G[0]-G[10]), and the corresponding pixels execute the data writing operation. Moreover, when the common voltage COMP[1] is equal to the fourth voltage V4, the common voltage COMN[1] is now equal to the second voltage V2, and the pixel region 111 corresponding to the common voltage COMP[1] and the common voltage COMN[1] also makes the corresponding pixels to execute the data writing operation to receive data voltages.

When the common voltage COMP[2] is equal to the second voltage V2, the common voltage COMN[2] is not equal to the fourth voltage V4, and the pixel region 112 corresponding to the common voltage COMP[2] and the common voltage COMN[2] may execute the dada writing operation, i.e. a plurality of pixels in the pixel region 112 may receive corresponding gate driving signals (i.e. gate driving signals G[8]-G[18]), so that the corresponding pixels execute the data writing operation to receive data voltages. Moreover, when the common voltage COMP[2] is equal to the fourth voltage V4, the common voltage COMN[2] is now equal to the second voltage V2, and the pixel region 112 corresponding to the common voltage COMP[2] and the common voltage COMN[2] also makes the corresponding pixels to execute the data writing operation to receive data voltages.

It should be noted that in a display mode, when each of the common voltages (i.e. the common voltages COMP[1], COMN[1], COMP[2], COMN[2]) is equal to the first voltage V1, and when each of the common voltages COMP[1], COMN[1], COMP[2], COMN[2] is equal to the fifth voltage V5, the pixel region corresponding to each of the common voltages COMP[1], COMN[1], COMP[2], COMN[2] may execute a pre-charge operation. For example, when the common voltage COMP[1] is equal to the first voltage V1, the common voltage COMN[1] is now equal to the fifth voltage V5, and the pixel region 111 corresponding to the common voltage COMP[1] and the common voltage COMN [1] may execute the pre-charge operation. On the other hand, when the common voltage COMP[1] is equal to the fifth voltage V5, the common voltage COMN[1] is now equal to the first voltage V1, and the pixel region 111 corresponding to the common voltage COMP[1] and the common voltage COMN[1] may also execute the pre-charge operation.

Similarly, when the common voltage COMP[2] is equal to the first voltage V1, the common voltage COMN[2] is now equal to the fifth voltage V5, and the pixel region 112 corresponding to the common voltage COMP[2] and the common voltage COMN[2] may execute the pre-charge operation. When the common voltage COMP[2] is equal to the fifth voltage V5, the common voltage COMN[2] is now equal to the first voltage V1, and the pixel region 112 corresponding to the common voltage COMP[2] and the common voltage COMN[2] may also execute the pre-charge operation. In this way, by pre-charging a plurality of pixels in each of the pixel regions, a response speed of the pixels in each of the pixel regions is enhanced.

Figure 1C:
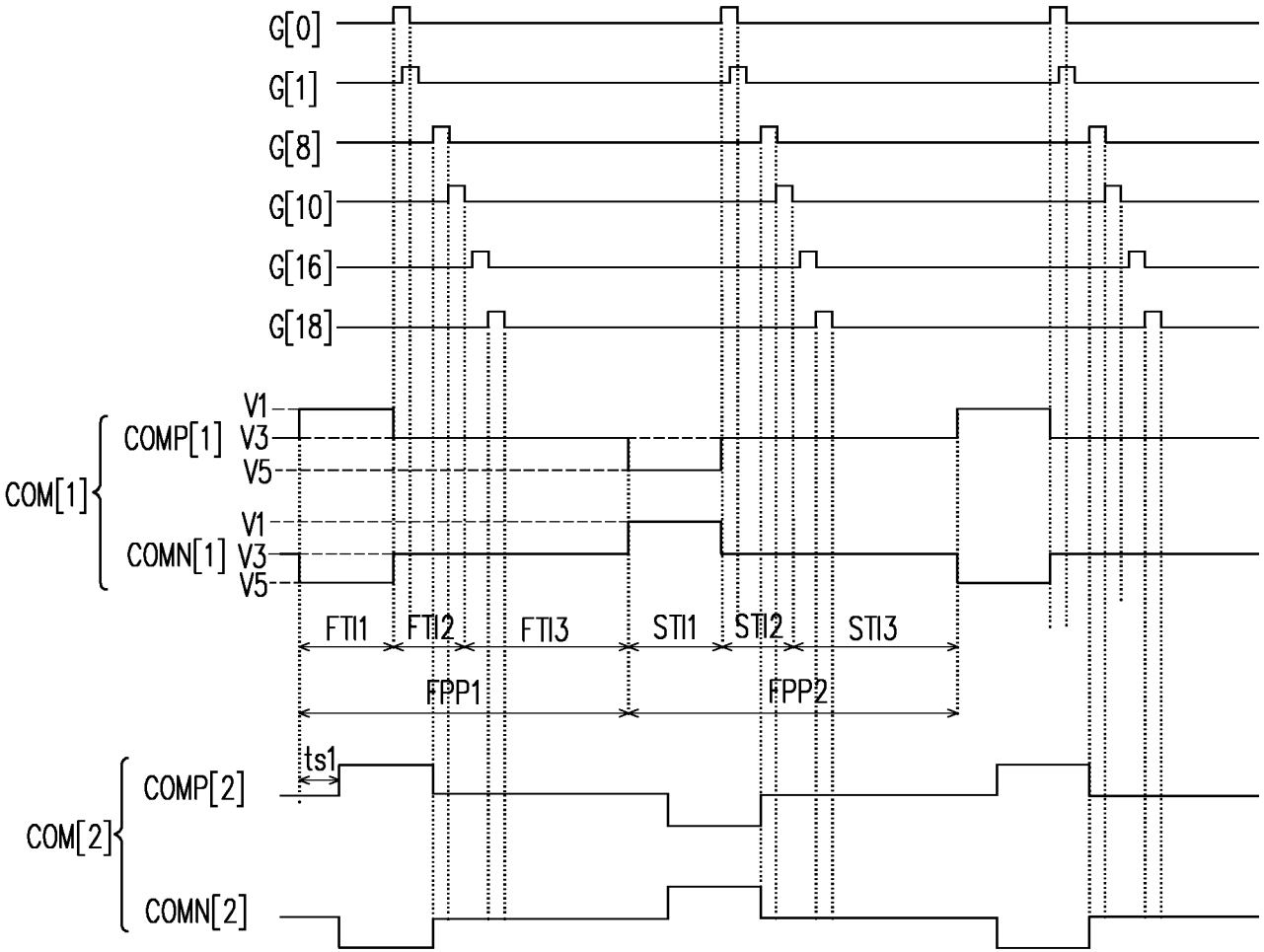
FIG. 1C is a signal waveform schematic diagram of the display apparatus of the embodiment of FIG. 1 in a fast response mode.

Then, referring to FIG. 1 and FIG. 1C, FIG. 1C is a signal waveform schematic diagram of the display apparatus of the embodiment of FIG. 1 in a fast response mode. In the embodiment, when the display apparatus is operated in the fast response mode, each of the common voltages COMP[1], COMN[1], COMP[2], COMN[2] in each of the common voltage pairs COM[1], COM[2] is respectively maintained to the first voltage V1 and the third voltage V3 in a plurality of the first time intervals (for example, the time intervals FTI1, FTI2, FTI3) in the first polarity driving period FPP1, and is respectively maintained to the fifth voltage V5 and the third voltage V3 in a plurality of the second time intervals (for example, the time intervals STI1, STI2, STI3) in the second polarity driving period FPP2. It should be noted that for simplicity's sake, only two common voltage pairs and 0-18$^{th}$ pixels are illustrated in FIG. 1C to serve as an exemplary embodiment, though the invention is not limited thereto.

Further, different to the aforementioned narrow vide mode, in the fast response mode, the common voltage COMP[1] in the common voltage pair COM1[1] is maintained to the first voltage V1 in the time interval Fill in the first polarity driving period FPP1. The common voltage COMP[1] is maintained to the third voltage V3 in the time interval FTI2 after the time interval FTI1. The common voltage COMP[1] is maintained to the third voltage V3 in the time interval FTI3 after the time interval FTI2.

Then, in the second polarity driving period FPP2 after the first polarity driving period FPP1, in the time interval STI1, the common voltage COMP[1] is maintained to the fifth voltage V5. In the time interval STI2 after the time interval STI1, the common voltage COMP[1] is maintained to the third voltage V3. In the time interval STI3 after the time interval STI2, the common voltage COMP[1] is continuously maintained to the third voltage V3, where the third voltage V3 is, for example, zero voltage, though the invention is not limited thereto. It should be noted that signal waveforms and voltage magnitudes of the common voltage COMP[2] and the common voltage COMN[2] in the common voltage pair COM[2] in each of the time intervals in the first polarity driving period and the second polarity driving period are similar to that of the common voltage COMP[1] and the common voltage COMN[1] in the common voltage pair COM[1], so that details thereof are not repeated.

Moreover, in the fast response mode, when each of the common voltages (i.e. the common voltages COMP[1], COMN[1], COMP[2], COMN[2]) is equal to the third voltage V3, the pixel region corresponding to each of the common voltages may execute the data writing operation. For example, when the common voltage COMP[1] is equal to the third voltage V3, the common voltage COMN[1] is now also equal to the third voltage V3, and the pixel region 111 corresponding to the common voltage COMP[1] and the common voltage COMN[1] may execute the data writing operation, i.e. a plurality of pixels in the pixel region 111 may receive the corresponding gate driving signals (i.e. the gate driving signals G[0]-G[10]), and the corresponding pixels execute the data writing operation to receive data voltages.

On the other hand, when the common voltage COMP[2] is equal to the third voltage V3, the common voltage COMN[2] is now also equal to the third voltage V3, and the pixel region 112 corresponding to the common voltage COMP[2] and the common voltage COMN[2] may execute the data writing operation, i.e. a plurality of pixels in the pixel region 112 may receive the corresponding gate driving signals (i.e. the gate driving signals G[8]-G[18]), and the corresponding pixels execute the data writing operation to receive data voltages.

It should be noted that in the fast response mode, the other signal characteristics and operations (for example, the common voltage complementary characteristic, time shift of the adjacent common voltages, the pre-charge operation, etc.) of the common voltage pair COM[1], COM[2] are similar to that in the narrow view mode, and details thereof are not repeated.

Figure 1D:
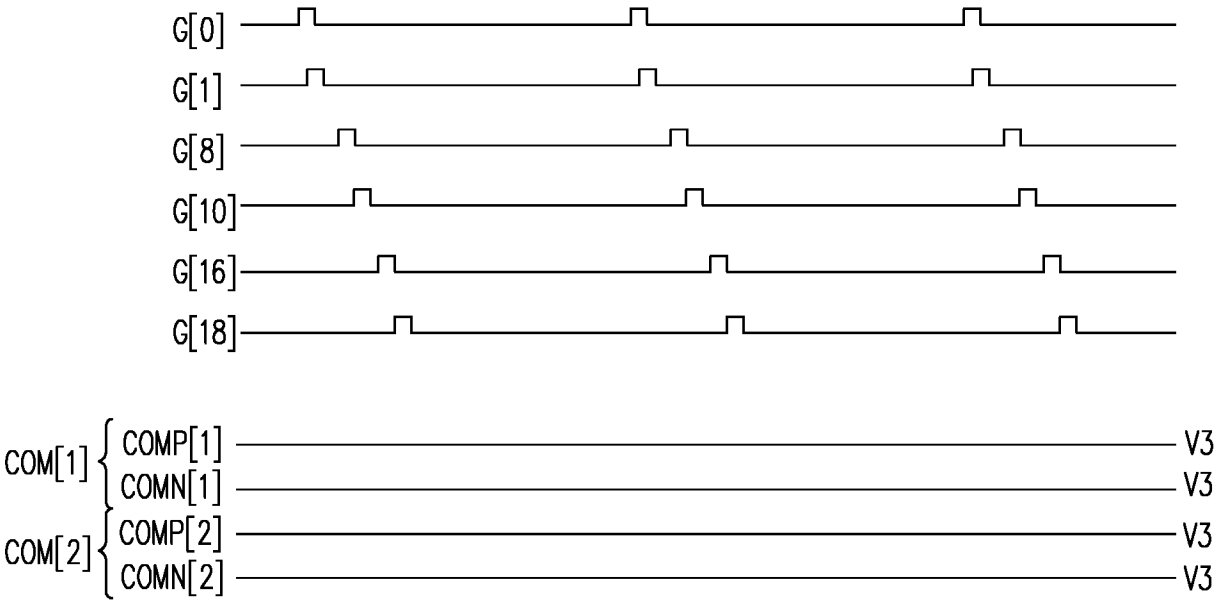
FIG. 1D is a signal waveform schematic diagram of the display apparatus of the embodiment of FIG. 1 in a normal display mode.

Moreover, referring to FIG. 1A and FIG. 1D, FIG. 1D is a signal waveform schematic diagram of the display apparatus of the embodiment of FIG. 1 in a normal display mode. In the embodiment, when the display apparatus is operated in the normal display mode, different to the aforementioned fast response mode, each of the common voltages COMP[1], COMN[1], COMP[2], COMN[2] in each of the common voltage pairs COM[1], COM[2] is maintained to the third voltage V3 in a plurality of first time intervals (for example, the time intervals FTI1, FTI2, FTI3 of FIG. 1C and FIG. 1B) in a first polarity driving period (for example, the first polarity driving period FPP1 of FIG. 1C and FIG. 1B, and is maintained to the third voltage V3 in a plurality of second time intervals (for example, the time intervals STI1, STI2, STI3 of FIG. 1C and FIG. 1B) in a second polarity driving period (for example, the second polarity driving period FPP2 of FIG. 1C and FIG. 1B. In this way, the display panel of the display apparatus of the invention may have a wide-angle display image in the normal display mode.

It should be noted that the display apparatus 100 of the invention may be switched among the narrow view mode, the fast response mode and the normal display mode according to an input command. In other words, the user may adjust the input command according to a current usage demand, so as to make the display panel to operate in the normal display mode, the narrow view mode, or the fast response mode, which improves convenience and commercial application of the display apparatus.

Figure 2A:
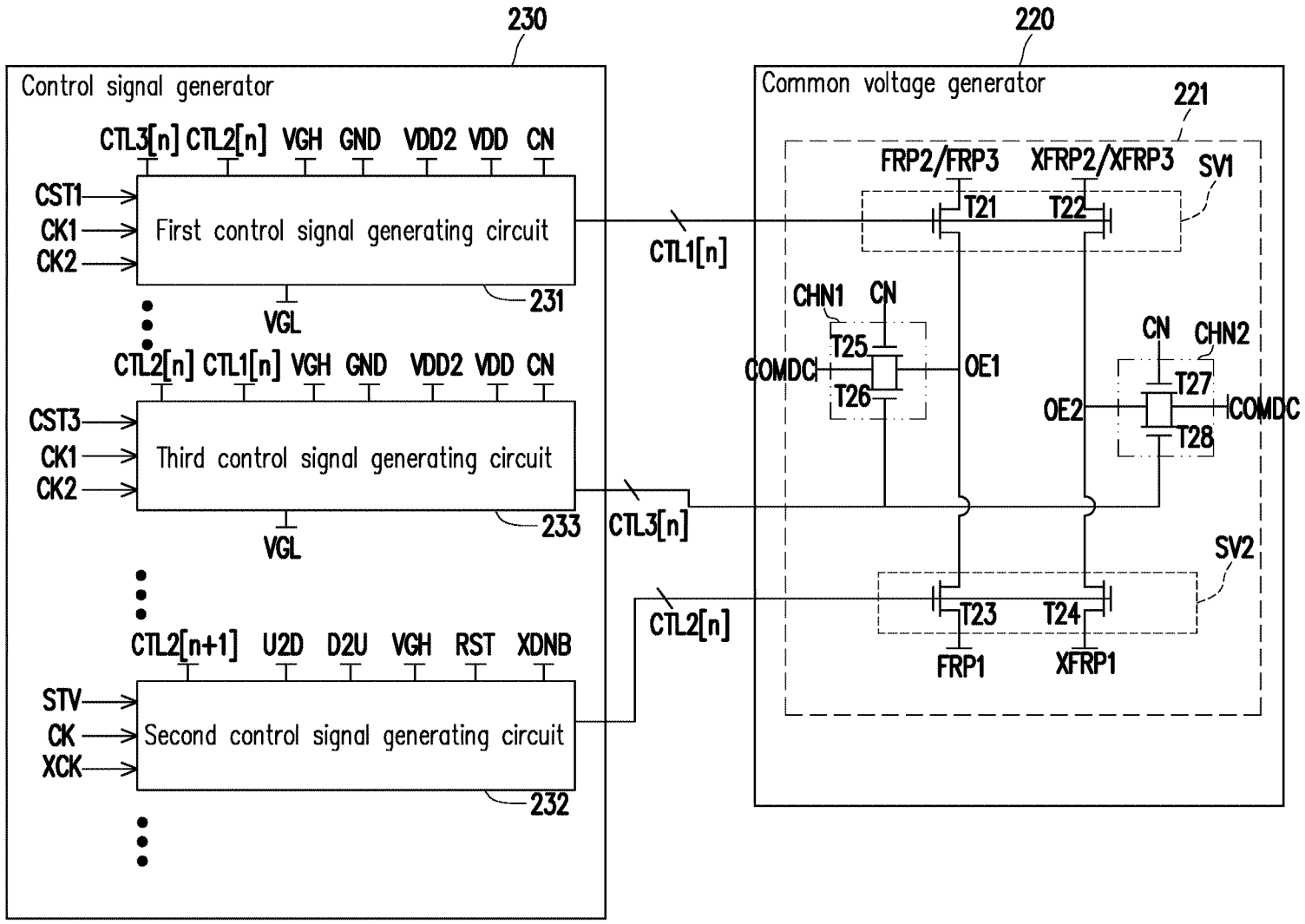
FIG. 2A is a schematic diagram of a circuit framework of a common voltage generator and a control signal generator of a display apparatus according to an embodiment of the invention.
Figure 2B:
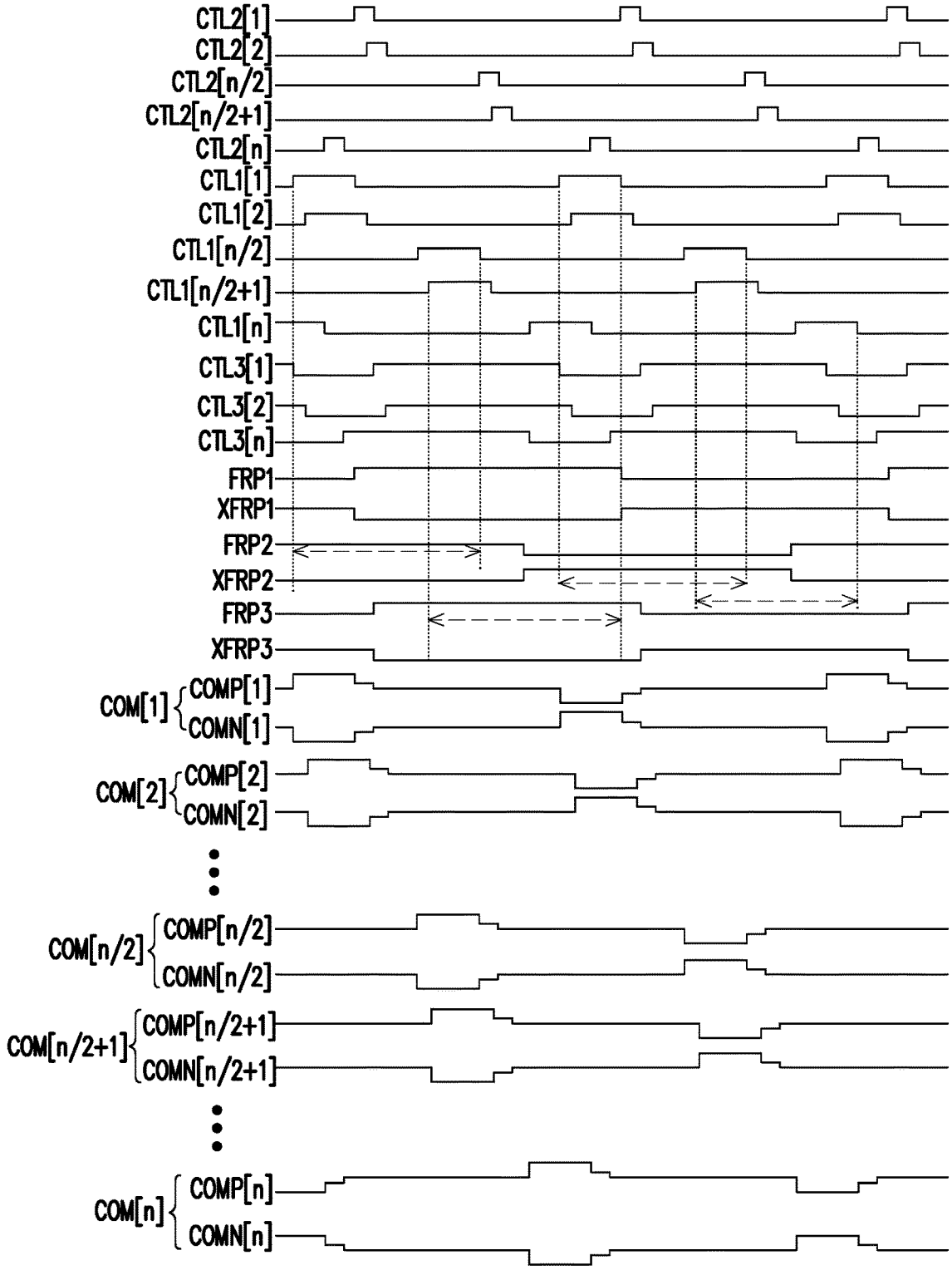
FIG. 2B is a signal waveform schematic diagram of the display apparatus of the embodiment of FIG. 2A in the narrow view mode.
Figure 2C:
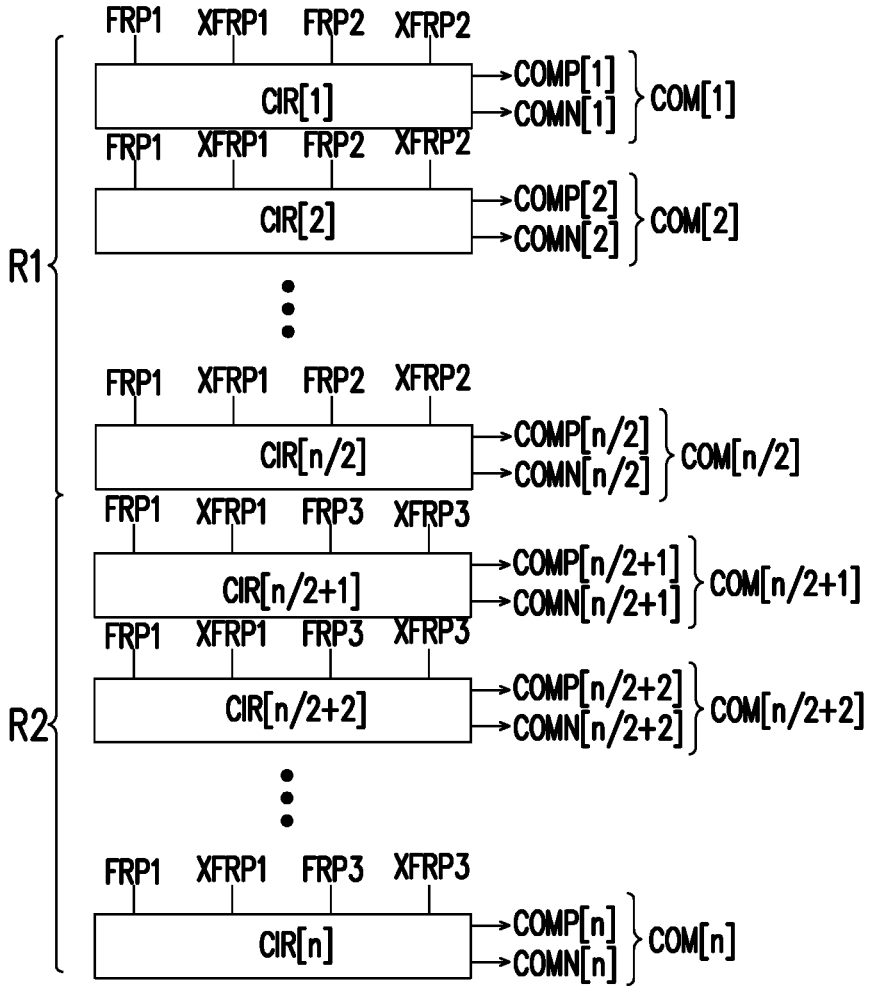
FIG. 2C is a schematic diagram of the common voltage generator of the display apparatus of the embodiment of FIG. 2A.

Referring to FIG. 2A, FIG. 2B and FIG. 2C, FIG. 2A is a schematic diagram of a circuit framework of a common voltage generator and a control signal generator of a display apparatus according to an embodiment of the invention. FIG. 2B is a signal waveform schematic diagram of the display apparatus of the embodiment of FIG. 2A in the narrow view mode. FIG. 2C is a schematic diagram of the common voltage generator of the display apparatus of the embodiment of FIG. 2A. In the embodiment, the display apparatus includes a plurality of common voltage generators (for example, n common voltage generators, where n is a positive integer), and each of the common voltage generators (for example, a common voltage generator 220 of FIG. 2A) includes a common voltage selection circuit (for example, a common voltage selection circuit 221 of FIG. 2A and common voltage selection circuits CIR[1]-CIR[n] of FIG. 2C).

In the n common voltage generators of the embodiment, an $n^{th}$ common voltage generator (i.e. the common voltage generator 220) is taken as an example for description. The common voltage generator 220 includes the common voltage selection circuit 221, and the common voltage selection circuit 221 is coupled to the control signal generator 230, where the control signal generator 230 is, for example, a timing controller in the display apparatus, though the invention is not limited thereto. It should be noted that for simplicity's sake, only one common voltage generator 220 is illustrated in FIG. 2A to serve as an exemplary embodiment, and the number of the common voltage generators is not limited thereto.

In detail, the common voltage selection circuit 221 of the embodiment may select a charging signal FRP1, a charging signal FRP2, a charging signal FRP3 or a charging signal COMDC according to a first control signal CTL1[n], a second control signal CTL2[n] and a third control signal CTL3[n] to charge an output terminal OE1, so as to generate a first common voltage (for example, a common voltage COMP[n] in FIG. 2B and FIG. 2C), and select a reverse charging signal XFRP1, a reverse charging signal XFRP2, a reverse charging signal XFRP3, or the charging signal COMDC to charge an output terminal OE2, so as to generate a second common voltage (for example, a common voltage COMN[n] in FIG. 2B and FIG. 2C).

In the embodiment, the common voltage selection circuit 221 includes a voltage selector SV1, a voltage selector SV2, a transmission gate CHN1 and a transmission gate CHN2. The voltage selector SV1 provides the charging signal FRP2 or the charging signal FRP3 to the output terminal OE1 according to the first control signal CTL1[n], and provides the reverse charging signal XFRP2 or the reverse charging signal XFRP3 to the output terminal OE2.

In detail, the voltage selector SV1 of the embodiment includes transistors T21 and T22, where a first terminal of the transistor T21 receives the charging signal FRP2 or the charging signal FRP3, a control terminal of the transistor T21 receives the first control signal CTL1[n], and a second terminal of the transistor T21 is coupled to the output terminal OE1. A first terminal of the transistor T22 receives the reverse charging signal XFRP2 or the reverse charging signal XFRP3, a control terminal of the transistor T22 also receives the first control signal CTL1[n], and a second terminal of the transistor T22 is coupled to the output terminal OE2.

The voltage selector SV2 is coupled to the voltage selector SV1, and provides the charging signal FRP1 to the output terminal OE1 and provides the reverse charging single XFRP1 to the output terminal OE2 according to the second control signal CTL2[n]. In the embodiment, the voltage selector SV2 includes transistors T23 and T24, where a first terminal of the transistor T23 receives the charging signal FRP1, a control terminal of the transistor T23 receives the second control signal CTL2[n], and a second terminal of the transistor T23 is coupled to the output terminal OE1. A first terminal of the transistor T24 receives the reverse charging signal XFRP1, a control terminal of the transistor T24 also receives the second control signal CTL2[n], and a second terminal of the transistor T24 is coupled to the output terminal OE2.

The transmission gate CHN1 is coupled between the voltage selector SV1 and the voltage selector SV2, and provides the charging signal COMDC to the output terminal OE1 according to the third control signal CTL3[n] or a first mode selection signal CN. In the embodiment, the transmission gate CHN1 includes transistors T25 and T26, where a first terminal of the transistor T25 is coupled to a first terminal of the transistor T26, a second terminal of the transistor T25 is coupled to a second terminal of the transistor T26, a control terminal of the transistor T25 receives the first mode selection signal CN, the first terminal of the transistor T26 receives the charging signal COMDC, a control terminal of the transistor T26 receives the third control signal CTL3[n], and the second terminal of the transistor T26 is coupled to the output terminal OE1.

The transmission gate CHN2 is coupled between the voltage selector SV1 and the voltage selector SV2, and provides the charging signal COMDC to the output terminal OE2 according to the third control signal CTL3[n] or the first mode selection signal CN. In the embodiment, the transmission gate CHN2 includes transistors T27 and T28, where a first terminal of the transistor T27 is coupled to a first terminal of the transistor T28, a second terminal of the transistor T27 is coupled to a second terminal of the transistor T28, a control terminal of the transistor T27 receives the first mode selection signal CN, the first terminal of the transistor T28 receives the charging signal COMDC, a control terminal of the transistor T28 receives the third control signal CTL3[n], and the second terminal of the transistor T28 is coupled to the output terminal OE2.

Further, as shown in FIG. 2B, a plurality of common voltages generated by n common voltage generators of the embodiment may include n common voltage pairs (for example, common voltage pairs COM[1], COM[2]-COM[n/2], COM[n/2+1]-COM[n]), and each of the common voltage pairs COM[1]-COM[n] includes a first common voltage and a second common voltage, where the first common voltage and the second common voltage are complementary. For example, the common voltage pair COM[1] includes a first common voltage (i.e. the common voltage COMP[1]) and a second common voltage (i.e. the common voltage COMN[1]), and the common voltage COMP[1] and the common voltage COMN[1] are complementary; the common voltage pair COM[2] includes a first common voltage (i.e. the common voltage COMP[2]) and a second common voltage (i.e. the common voltage COMN[2]), and the common voltage COMP[2] and the common voltage COMN[2] are complementary; and the common voltage pair COM[n/2] includes a first common voltage (i.e. a common voltage COMP[n/2]) and a second common voltage (i.e. a common voltage COMN[n/2]), and the common voltage COMP[n/2] and the common voltage COMN[n/2] are complementary, and the others are deduced by analogy.

It should be noted that the charging signal FRP1 and the reverse charging signal XFRP1 may be transited between the second voltage V2 and the fourth voltage V4, and the charging signal FRP2, the charging signal FRP3, the reverse charging signal XFRP2 and the reverse charging signal XFRP3 may be transited between the first voltage V1 and the fifth voltage V5, and a voltage value of the charging signal COMDC is equal to the third voltage V3.

In this way, the common voltage selection circuit 221 of the embodiment may select and adjust the common voltages required in different modes according to the first control signal CTL1[n], the second control signal CTL2[n] and the third control signal CTL3[n]. For example, when the display apparatus is operated in the narrow view mode, the common voltage selection circuit 221 may provide the charging signal FRP1 and the reverse charging signal XFRP1 according to the second control signal CTL2[n], such that the common voltage COMP[n] may be respectively maintained at the second voltage V2 and the fourth voltage V4 in different time intervals, and the common voltage COMN[n] may be respectively maintained at the second voltage V2 and the fourth voltage V4 in different time intervals.

The common voltage selection circuit 221 may provide the charging signal FRP2 (or the charging signal FRP3) and the reverse charging signal XFRP2 (or the reverse charging signal XFRP3) according to the first control signal CTL1[n], such that the common voltage COMP[n] may be respectively maintained at the first voltage V1 and the fifth voltage V5 in different time intervals, and the common voltage COMN[n] may be respectively maintained at the first voltage V1 and the fifth voltage V5 in different time intervals. The common voltage selection circuit 221 may provide the charging signal COMDC according to the third control signal CTL3[n], such that the common voltage COMP[n] may be respectively maintained at the third voltage V3 in different time intervals, and the common voltage COMN[n] may be respectively maintained at the third voltage V3 in different time intervals.

Namely, in order to make the display apparatus operating in the fast response mode, it is only required to switch the charging signal FRP1 and the reverse charging signal XFRP1 to the charging signal COMDC, and the original second voltage V2 and the fourth voltage V4 may be replaced by the third voltage V3, so as to generate the common voltage required in the fast response mode. In order to make the display apparatus operating in the normal display mode, it is required to switch the charging signal FRP1, the reverse charging signal XFRP1, the charging signal FRP2, the reverse charging signal XFRP2, the charging signal FRP3 and the reverse charging signal XFRP3 to the charging signal COMDC, and the original first voltage V1, the second voltage V2, the fourth voltage V4 and the fifth voltage V5 may be replaced by the third voltage V3, so as to generate the common voltage required in the normal display mode.

On the other hand, in the embodiment, the control signal generator 230 includes a plurality of first control signal generating circuits (for example, n first control signal generating circuits), a plurality of second control signal generating circuits (for example, n second control signal generating circuits) and a plurality of third control signal generating circuits (for example, n third control signal generating circuits). It should be noted that the n first control signal generating circuits are connected in series with each other, and generate n first control signals (for example, first control signals CTL1[1]-CTL1[n] shown in FIG. 2B), where the first control signal generating circuit of an $n^{th}$ stage is used for generating the first control signal CTL1[n]. n second control signal generating circuits are connected in series with each other, and generate n second control signals (for example, second control signals CTL2[1]-CTL2[n] shown in FIG. 2B), where the second control signal generating circuit of the $n^{th}$ stage is used for generating the second control signal CTL2[n]. n third control signal generating circuits are connected in series with each other, and generate n third control signals (for example, third control signals CTL3[1]-CTL3[n] shown in FIG. 2B), where the third control signal generating circuit of the $n^{th}$ stage is used for generating the third control signal CTL3[n].

The first control signal generating circuit 231 of the $n^{th}$ stage, the second control signal generating circuit 232 of the $n^{th}$ stage and the third control signal generating circuit 233 of the $n^{th}$ stage are taken as an example for description. The first control signal generating circuit 231 of the $n^{th}$ stage receives a clock signal CK1, a clock signal CK2, the first mode selection signal CN, a start pulse signal CST1 or a previous-stage first control signal, the second control signal CTL2[n], a gate high voltage VGH, a ground voltage GND, a power voltage VDD or the third control signal CTL3[n] to provide a gate low voltage VGL or a power voltage VDD2 to generate the first control signal CTL1[n].

The second control signal generating circuit 232 of the $n^{th}$ stage may receive a reverse clock signal XCK, a reset signal RST, a start pulse signal STV or a previous-stage second control signal, the gate high voltage VGH, a scan voltage U2D, a scan voltage D2U or a post-stage second control signal CTL2[n+1] to provide a reference voltage XDHB or a clock signal CK to generate the second control signal CTL2[n].

Moreover, the third control signal generating circuit 233 of the $n^{th}$ stage may receive the clock signal CK1, the clock signal CK2, the first mode selection signal CN, the start pulse signal CST3 or the previous-stage control signal, the first control signal CTL1[n], the gate high voltage VGH, the ground voltage GND, the power voltage VDD or the second control signal CTL2[n] to provide the gate low voltage VGL or the power voltage VDD2 to generate the third control signal CTL3[n].

Moreover, it should be noted that as shown in FIG. 2C, the n common voltage generators of the display apparatus of the embodiment respectively include n common voltage selection circuits (i.e. common voltage selection circuits CIR1, CIR2-CIR[n/2], CIR[n/2+1], CIR[n/2+2]-CIR[n]), and a plurality of common voltages generated by the n common voltage selection circuits respectively include n common voltage pairs (i.e. the common voltage pairs COM[1], COM[2]-COM[n/2], COM[n/2+1], COM[n/2+2]-COM[n]). Moreover, in the embodiment, the common voltage selection circuits are divided into two regions (for example, a front half stage region R1 and a rear half stage region R2), the front half stage region R1 includes the $1^{st}$-$n/2^{th}$ common voltage selection circuits (i.e. the common voltage selection circuits CIR1, CIR2-CIR[n/2]), and the rear half stage region R2 includes the $n/(2+1)^{th}$–$n^{th}$ common voltage selection circuits (i.e. the common voltage selection circuits CIR[n/2+1], CIR[n/2+2]-CIR[n]).

In the front half stage region R1, each of the common voltage selection circuits CIR1, CIR2-CIR[n/2] receives the charging signal FRP1, the reverse charging signal XFRP1, the charging signal FRP2 and the reverse charging signal XFRP2 to output a plurality of common voltage pairs. For example, the common voltage selection circuit CIR1 may select to generate the common voltage COMP[1] and the common voltage COMN[1] in the common voltage pair COM[1] according to the charging signal FRP1, the reverse charging signal XFRP1, the charging signal FRP2 and the reverse charging signal XFRP2, and the common voltage selection circuit CIR2 may select to generate the common voltage COMP[2] and the common voltage COMN[2] in the common voltage pair COM[2] according to the charging signal FRP1, the reverse charging signal XFRP1, the charging signal FRP2 and the reverse charging signal XFRP2, and the others are deduced by analogy.

On the other hand, in the rear half stage region R2, each of the common voltage selection circuits CIR[n/2+1], CIR[n/2+2]-CIR[n] receives the charging signal FRP1, the reverse charging signal XFRP1, the charging signal FRP3 and the reverse charging signal XFRP3 to output a plurality of common voltage pairs. For example, the common voltage selection circuit CIR[n/2+1] may select to generate the common voltage COMP[n/2+1] and the common voltage COMN[n/2+1] in the common voltage pair COM[n/2+1] according to the charging signal FRP1, the reverse charging signal XFRP1, the charging signal FRP3 and the reverse charging signal XFRP3, and the common voltage selection circuit CIR[n/2+2] may select to generate the common voltage COMP[n/2+2] and the common voltage COMN[n/2+2] in the common voltage pair COM[n/2+2] according to the charging signal FRP1, the reverse charging signal XFRP1, the charging signal FRP3 and the reverse charging signal XFRP3, and the others are deduced by analogy.

In this way, by respectively providing the charging signal FRP2 and the reverse charging signal XFRP2 to each of the common voltage selection circuits CIR1, CIR2-CIR[n/2] in the front half stage region R1, and respectively providing the charging signal FRP3 and the reverse charging signal XFRP3 to each of the common voltage selection circuits CIR[n/2+1], CIR[n/2+2]-CIR[n] in the rear half stage region R2, the common voltage selection circuits in the front half stage region R1 and the rear half stage region R2 respectively receive different charging signals, so as to achieve an effect of simplifying an overall circuit of the common voltage generators.

Figure 3A:
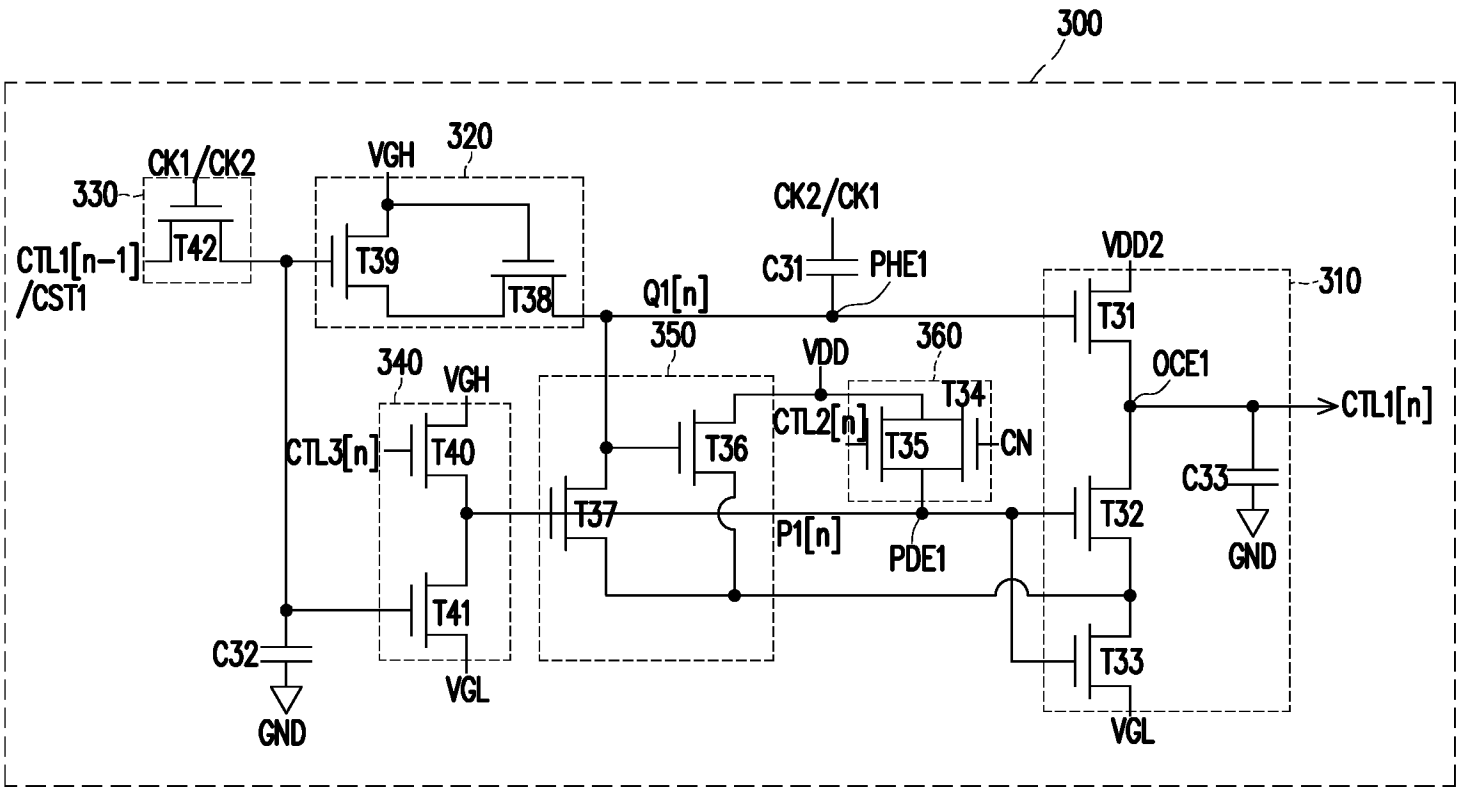
FIG. 3A is a schematic diagram of a circuit framework of a first control signal generating circuit according to an embodiment of the invention.

Referring to FIG. 3A, FIG. 3A is a schematic diagram of a circuit framework of a first control signal generating circuit according to an embodiment of the invention. In the embodiment, the control signal generator of the display apparatus has n first control signal generating circuits, where the first control signal generating circuit 300 of the $n^{th}$ stage includes an output stage circuit 310, a voltage regulator 320, a voltage regulator 330, a voltage regulator 340, a voltage regulator 350, a capacitor C31 and a capacitor C32.

The output stage circuit 310 has a pull-high control end PHE1 and a pull-down control end PDE1 to respectively receive a pull-high control signal Q1[n] and a pull-down control signal P1[n], and provides the power voltage VDD2 or the gate low voltage VGL to charge a control output end OCE1 according to the pull-high control signal Q1[n] and the pull-down control signal P1[n], so as to generate the first control signal CTL1[n]. In the embodiment, the output stage circuit 310 includes transistors T31, T32, T33 and a capacitor C33. A first terminal of the transistor T31 receives the power voltage VDD2, a control terminal of the transistor T31 receives the pull-high control signal Q1[n], and a second terminal of the transistor T31 is coupled to the control output end OCE1; a first terminal of the transistor T32 is coupled to the control output end OCE1, a control terminal of the transistor T32 receives the pull-down control signal P1[n], and a second terminal of the transistor T32 is coupled to a first terminal of the transistor T33, a control terminal of the transistor T33 receives the pull-down control signal P1[n], and a second terminal of the transistor T33 receives the gate low voltage VGL. One end of the capacitor C33 is coupled to the control output end OCE1, and another end of the capacitor C33 is coupled to the ground voltage GND. On the other hand, one end of the capacitor C31 is coupled to the pull-high control end PHE1, and another end thereof receives the clock signal CK1 and the clock signal CK2.

The voltage regulator 330 is coupled to the voltage regulator 320, and provides the start pulse signal CST1 or the previous-stage first control signal CTL1[n−1] to set the voltage regulator 320 according to the clock signal CK1 and the clock signal CK2. In the embodiment, the voltage regulator 330 includes a transistor T42, where a first terminal of the transistor T42 receives the start pulse signal CST1 or the previous-stage first control signal CTL1[n−1], a second terminal of the transistor T42 is coupled to the voltage regulator 320, and a control terminal of the transistor T42 receives the clock signal CK1 and the clock signal CK2. It should be noted that the number of transistors in the voltage regulator 330 may be one or plural. The drawing of FIG. 3A is only an example, which is not used for limiting the scope of the invention.

It should be noted that the voltage regulator 330 may receive the start pulse signal CST1, or receive the previous-stage first control signal CTL1[n−1]. The voltage regulator 330 may determine to receive the start pulse signal CST1 or the previous-stage first control signal CTL1[n−1] according to a position of the corresponding first control signal generating circuit. In brief, when the voltage regulator 330 belongs to the first control signal generating circuit of the first stage, the voltage regulator 330 may receive the start pulse signal CST1, and when the voltage regulator 330 does not belong to the first control signal generating circuit of the first stage, the voltage regulator 330 may receive the previous-stage first control signal CTL1[n−1].

The voltage regulator 320 is coupled to the pull-high control end PHE1, and provides the gate high voltage VGH to adjust the pull-high control signal Q1[n] according to the start pulse signal CST1 or the previous-stage first control signal CTL1[n−1] transmitted by the voltage regulator 330. In the embodiment, the voltage regulator 320 includes transistors T38, T39, where a first terminal of the transistor T38 is coupled to a second terminal of the transistor T39, a second terminal of the transistor T38 is coupled to the pull-high control end PHE1, and a control terminal of the transistor T38 receives the gate high voltage VGH. A first terminal of the transistor T39 receives the gate high voltage VGH, the second terminal of the transistor T39 is coupled to the first terminal of the transistor T39, and a control terminal of the transistor T39 receives the start pulse signal CST1 or the previous-stage first control signal CTL1[n−1].

The voltage regulator 340 is coupled between the pull-down control end PDE1 and the voltage regulator 330. The voltage regulator 340 provides the gate high voltage VGH or the gate low voltage VGL to adjust the pull-down control signal P1[n] according to the third control signal CTL3[n], the start pulse signal CST1 or the previous-stage first control signal CTL1[n−1]. In the embodiment, the voltage regulator 340 includes transistors T40 and T41, where a first terminal of the transistor T40 receives the gate high voltage VGH, a control terminal of the transistor T40 receives the third control signal CTL3[n], and a second terminal of the transistor T40 is coupled to the pull-down control end PDE1. A first terminal of the transistor T41 is coupled to the pull-down control end PDE1, a control terminal of the transistor T41 receives the start pulse signal CST1 or the previous-stage first control signal CTL1[n−1], and a second terminal of the transistor T41 receives the gate low voltage VGL. It should be noted that one end of the capacitor C31 is coupled to the control terminal of the transistor T41, and another end of the capacitor C32 is coupled to the ground voltage GND.

The voltage regulator 350 is coupled between the pull-high control end PHE1 and the output stage circuit 310, and provides the pull-high control signal Q1[n] or the power voltage VDD to the output stage circuit 310 according to the pull-down control signal P1[n] or the pull-high control signal Q1[n]. In the embodiment, the voltage regulator 350 includes transistors T36 and T37, where a first terminal of the transistor T36 receives the power voltage VDD, a control terminal of the transistor T36 receives the pull-high control signal Q1[n], and a second terminal of the transistor T36 is coupled to a first terminal of the transistor T33 in the output stage circuit 310. A first terminal of the transistor T37 is coupled to the pull-high control end PHE1, a control terminal of the transistor T37 receives the pull-down control signal P1[n], and a second terminal of the transistor T37 is coupled to the second terminal of the transistor T36.

The voltage regulator 360 is coupled to the pull-down control end PDE1, and provides the power voltage VDD to adjust the pull-down control signal P1[n] according to the second control signal CTL2[n] or the first mode selection signal CN. In the embodiment, the voltage regulator 360 includes a transistor T34 and a transistor T35, where a first terminal of the transistor T34 is coupled to a first terminal of the transistor T35, a control terminal of the transistor T34 receives the first mode selection signal CN, and a second terminal of the transistor T34 is coupled to a second terminal of the transistor T35. The first terminal of the transistor T35 receives the power voltage VDD, a control terminal of the transistor T35 receives the second control signal VTL2[n], and the second terminal of the transistor T35 is coupled to the pull-down control end PDE1.

Figure 3B:
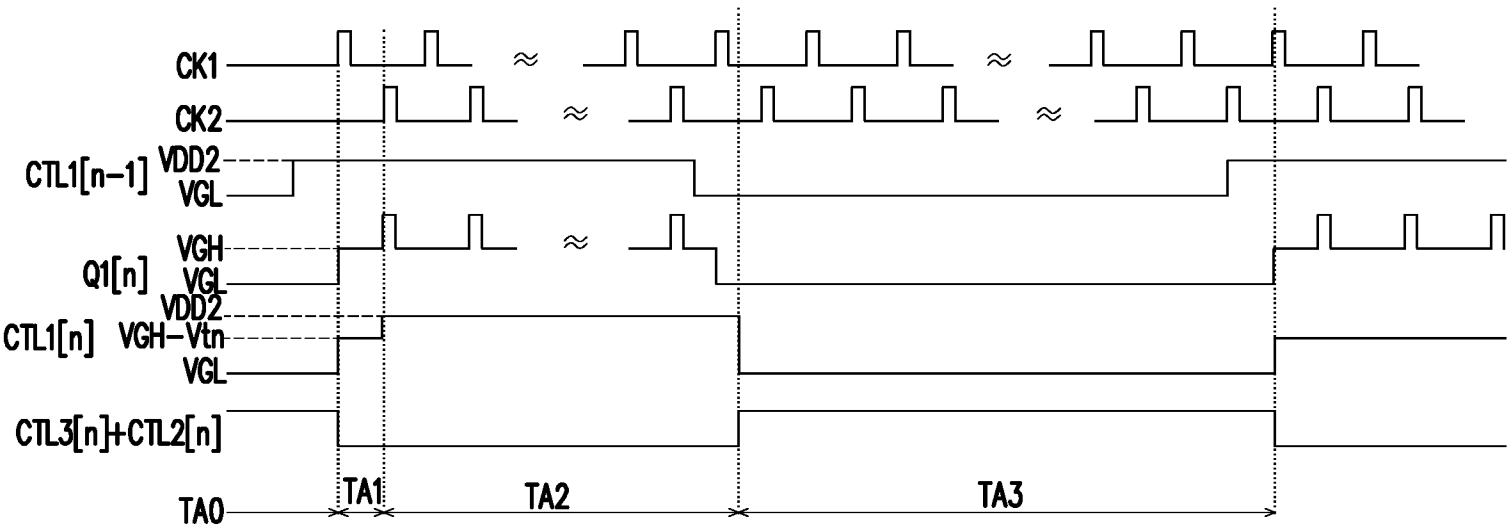
FIG. 3B is a signal waveform diagram of the first control signal generating circuit of the embodiment of FIG. 3A.

Referring to FIG. 3A and FIG. 3B, FIG. 3B is a signal waveform diagram of the first control signal generating circuit of the embodiment of FIG. 3A. In an initial time interval TA0, a control signal CTL2[n]+CTL3[n] is at an enabled voltage level, where the control signal CTL2[n]+CTL3[n] is a control signal obtained by executing a logic OR operation on the second control signal CTL2[n] and the third control signal CTL3[n]. The previous-stage first control signal CTL1[n−1] is transited from a disable voltage level to the enabled voltage level in such time interval. In the initial time interval TA0, the transistor T40 in the voltage regulator 340 is turned on according to the control signal CTL2[n]+CTL3[n] at the enabled voltage level, and transmits the gate high voltage VGH to the pull-down control end PDE1 to pull up a voltage value of the pull-down control signal P1[n] to the gate high voltage VGH. Meanwhile, the transistor T37 in the voltage regulator 350 is turned on according to the pulled-up pull-down control signal P1[n], and the transistors T33 and T32 in the output stage circuit 310 are turned on according to the pulled-up pull-down control signal P1[n], so as to transmit the gate low voltage VGL to the pull-high control end PHE1 through the transistors T33 and T37, such that the pull-high control signal Q1[n] is pulled down to the gate low voltage VGL, and the gate low voltage VGL is provided through the transistors T33 and T32 to charge the control output end OCE1, so as to generate the first control signal CTL1[n] equal to the gate low voltage VGL.

Then, in a time interval TA1 after the initial time interval TA0, the control signal CTL2[n]+CTL3[n] is transited from the enabled voltage level to the disabled voltage level, and the previous-stage first control signal CTL1[n−1] is maintained to the enabled voltage level. When the clock signal CK1 generates a positive pulse signal, the transistor T42 is turned on according to the positive pulse signal generated by the clock signal CK1, and transmits the previous-stage first control signal CTL1[n−1] to the voltage regulator 320 and the voltage regulator 340. The transistor T40 in the voltage regulator 340 is turned off according to the control signal CTL2[n]+CTL3[n] transited to the disabled voltage level, and the transistor T41 is turned on according to the previous-stage first control signal CTL1[n−1] with the enabled voltage level, so as to provide the gate low voltage VGL to the pull-down control end PDE1 to pull down the pull-down control signal P1[n] to the gate low voltage VGL.

The transistor T37 in the voltage regulator 350 is turned off according to the pulled down pull-down control signal P1[n], and the transistors T32 and T33 in the output stage circuit 310 are turned off according to the pull-down control signal P1[n]. The transistor T39 in the voltage regulator 320 is turned on according to the previous-stage first control signal CTL1[n−1] with the enabled voltage level, so as to provide the gate high voltage VGH to the pull-high control end PHE1 through the transistors T38 and T39, such that the pull-high control signal Q1[n] is pulled up to the gate high voltage VGH, and the transistor T31 in the output stage circuit 310 is turned on according to the pull-high control signal Q1[n], so as to provide the power voltage VDD2 to charge the control output end OCE1, so that a voltage value of the first control signal CTL1[n] is equal to VGH−Vtn, where Vtn is a turn-on voltage of the transistor T31.

In a time interval TA2 after the time interval TA1, the control signal CTL2[n]+CTL3[n] is maintained to the disabled voltage level, and the previous-stage first control signal CTL1[n−1] is maintained to the enabled voltage level. When the clock signal CK2 generates a positive pulse signal, the transistor T42 is turned on according to the positive pulse signal generated by the clock signal CK1, and transmits the previous-stage first control signal CTL1[n−1] to the voltage regulator 320 and the voltage regulator 340. The transistor T40 in the voltage regulator 340 is continuously turned off according to the control signal CTL2[n]+CTL3[n] with the disabled voltage level, and the transistor T41 is turned on according to the previous-stage first control signal CTL1[n−1] with the enabled voltage level, so as to provide the gate low voltage VGL to the pull-down control end PDE1 to continuously pull down the pull-down control signal P1[n].

The transistor T37 in the voltage regulator 350 is continuously turned off according to the pulled down pull-down control signal P1[n], and the transistors T32 and T33 in the output stage circuit 310 are turned off according to the pull-down control signal P1[n]. The transistor T39 in the voltage regulator 320 is turned on according to the previous-stage first control signal CTL1[n−1] with the enabled voltage level, so as to provide the gate high voltage VGH to the pull-high control end PHE1 through the transistors T38 and T39, and further pulls up the voltage value of the pull-high control signal Q1[n] by a positive pulse signal based on the gate high voltage VGH according to the pulse signal of the clock signal CK2, and the transistor T31 in the output stage circuit 310 is turned on according to the pulled up pull-high control signal Q1[n], so as to continuously provide the power voltage VDD2 to charge the control output end OCE1, so that the voltage value of the first control signal CTL1[n] is pulled up and maintained to the power voltage VDD2.

Then, in a time interval TA3 after the time interval TA2, the control signal CTL2[n]+CTL3[n] is transited from the disabled voltage level to the enabled voltage level, and now the previous-stage first control signal CTL1[n−1] is at the disabled voltage level. The transistor T41 in the voltage regulator 340 is maintained to the turn-off state according to the previous-stage first control signal CTL1[n−1], and the transistor T40 is turned on according to the control signal CTL2[n]+CTL3[n], so as to provide the gate high voltage VGH to the pull-down control end PDE1 to pull up the pull-down control signal P1[n] to the gate high voltage VGH. Meanwhile, the transistor T37 in the voltage regulator 350 is turned on according to the pulled-up pull-down control signal P1[n], and the transistors T33 and T32 in the output stage circuit 310 are turned on according to the pulled-up pull-down control signal P1[n], so as to transmit the gate low voltage VGL to the pull-high control end PHE1 through the transistors T33 and T37, such that the pull-high control signal Q1[n] is pulled down to the gate low voltage VGL, and the gate low voltage VGL is provided through the transistors T33 and T32 to charge the control output end OCE1, so as to pull down the voltage value of the first control signal CTL1[n] to the gate low voltage VGL.

Figure 4:
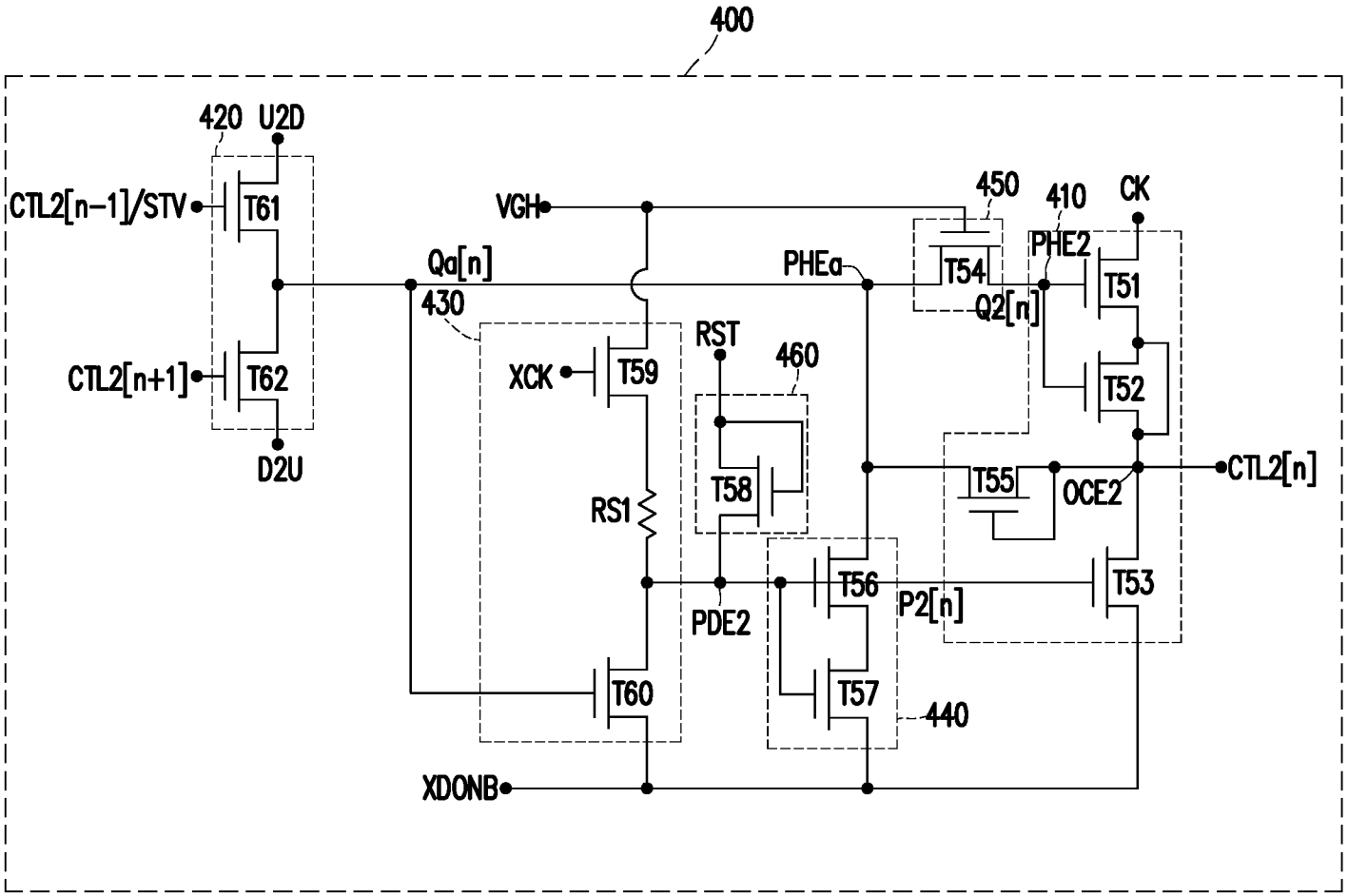
FIG. 4 is a schematic diagram of a circuit framework of a second control signal generating circuit according to an embodiment of the invention.

Referring to FIG. 4, FIG. 4 is a schematic diagram of a circuit framework of a second control signal generating circuit according to an embodiment of the invention. In the embodiment, the control signal generator of the display apparatus has n second control signal generating circuits, where the second control signal generating circuit 400 of the $n^{th}$ stage includes an output stage circuit 410, a voltage regulator 420, a voltage regulator 430, a voltage regulator 440, an isolation circuit 450 and a reset circuit 460.

The output stage circuit 410 has a pull-high control end PHE2 and a pull-down control end PDE2 to respectively receive a pull-high control signal Q2[n] and a pull-down control signal P2[n], and provides the clock signal CK and a reference voltage XDONB to charge a control output end OCE2 according to the pull-high control signal Q2[n] and the pull-down control signal P2[n], so as to generate a second control signal CTL2[n]. When the pull-high control signal Q2[n] is at the enabled voltage level, the output stage circuit 410 provides the clock signal CK to charge the control output terminal OCE2 according to the pull-high control signal Q2[n], so as to generate the second control signal CTL2[n]. When the pull-down control signal P2[n] is at the enabled voltage level, the output stage circuit 410 provides the reference voltage XDONB to charge the control output terminal OCE2 according to the pull-down control signal P2[n], so as to generate the second control signal CTL2[n].

In the embodiment, the output stage circuit 410 includes transistors T51, T52, T53 and T55. A first terminal of the transistor T51 receives the clock signal CK, a control terminal of the transistor T51 receives the pull-high control signal Q2[n], and a second terminal of the transistor T51 is coupled to a first terminal of the transistor T52; the first terminal of the transistor T52 is coupled to a second terminal of the transistor T52, a control terminal of the transistor T52 receives the pull-high control signal Q2[n], and the second terminal of the transistor T52 is coupled to the control output end OCE2; a first terminal of the transistor T53 is coupled to the control output end OCE2, a control terminal of the transistor T53 receives the pull-down control signal P2[n], and a second terminal of the transistor T53 receives the reference voltage XDONB. A control terminal of the transistor T55 is coupled to a second terminal of the transistor T55 to form a diode configuration. In the embodiment, an anode of the diode constructed by the transistor T55 is coupled to the control output end OCE2, and a cathode thereof is coupled to a pull-high control end PHEa.

The isolation circuit 450 is coupled between the pull-high control end PHE2 and the pull-high control end PHEa to connect the pull-high control end PHE2 and the pull-high control end PHEa according to the gate high voltage VGH, and transmit a pull-high control signal Qa[n] to serve as the pull-high control signal Q2[n]. In the embodiment, the isolation circuit 450 includes a transistor T54, and the transistor T54 is coupled between the pull-high control end PHE2 and the pull-high control end PHEa, and a control terminal of the transistor T54 receives the gate high voltage VGH. It should be noted that the number of the transistors included in the isolation circuit 450 may be one or plural. The drawing of FIG. 4 is only an example, which is not used for limiting the scope of the invention.

The voltage regulator 420 is coupled to the pull-high control end PHEa, and provides the scan voltage U2D or the scan voltage D2U to adjust the pull-high control signal Qa[n] according to a post-stage second control signal CTL2[n+1], a start pulse signal STV or a previous-stage second control signal CTL2[n−1]. The voltage regulator 420 provides the scan voltage U2D to adjust the pull-high control signal Qa[n] according to the start pulse signal STV or the previous-stage second control signal CTL2[n−1] with the enabled voltage level. The voltage regulator 420 provides the scan voltage D2U to adjust the pull-high control signal Qa[n] according to the post-stage second control signal CTL2[n+1] with the enabled voltage level.

It should be noted that the voltage regulator 420 may receive the start pulse signal STV or receive the previous-stage second control signal CTL2[n−1]. The voltage regulator 420 may determine to receive the start pulse signal STV or the previous-stage second control signal CTL2[n−1] according to a position of the corresponding second control signal generating circuit. In brief, when the voltage regulator 420 belongs to the second control signal generating circuit of the first stage, the voltage regulator 420 may receive the start pulse signal STV, and when the voltage regulator 420 does not belong to the second control signal generating circuit of the first stage, the voltage regulator 420 may receive the previous-stage second control signal CTL2[n−1].

In the embodiment, the voltage regulator 420 includes transistors T61 and T62, where a first terminal of the transistor T61 receives the scan voltage U2D, a control terminal of the transistor T61 receives the start pulse signal STV or the previous-stage second control signal CTL2[n−1], and a second terminal of the transistor T61 is coupled to the pull-high control end PHEa. A first terminal of the transistor T62 is coupled to the pull-high control end PHEa, a control terminal of the transistor T62 receives the post-stage second control signal CTL2[n+1], and a second terminal of the transistor T62 receives the scan voltage D2U.

The voltage regulator 430 is coupled between the pull-high control end PHEa and the pull-down control end PDE2, and provides the reference voltage XDONB or the gate high voltage VGH to adjust the pull-down control signal P2[n] according to the pull-high control signal Qa[n] or a reverse clock signal XCK. The voltage regulator 430 provides the gate high voltage VGH to the pull-down control end PDE2 through a resistor RS1 according to the reverse clock signal XCK with the enabled voltage level, so as to adjust the pull-down control signal P2[n]. The voltage regulator 430 provides the reference voltage XDONB to adjust the pull-down control signal P2[n] according to the pull-high control signal Qa[n] with the enabled voltage level.

In the embodiment, the voltage regulator 430 includes transistors T59 and T60, where a first terminal of the transistor T59 receives the gate high voltage VGH, a control terminal of the transistor T59 receives the reverse clock signal XCK, and a second terminal of the transistor T59 is coupled to one end of the transistor RS1, and another end of the resistor RS1 is coupled to the pull-down control end PDE2. A first terminal of the transistor T60 is coupled to the pull-down control end PDE2, a control terminal of the transistor T60 receives the pull-high control signal Qa[n], and a second terminal of the transistor T60 receives the reference voltage XDONB.

The voltage regulator 440 is coupled between the pull-high control end PHEa and the reference voltage XDONB, and provides the reference voltage XDONB to adjust the pull-high control signal Qa[n] according to the pull-down control signal P2[n]. In the embodiment, the voltage regulator 440 includes transistors T56 and T57, where the transistors T56 and T57 are sequentially connected in series between the pull-high control end PHEa and the reference voltage XDONB. Control terminals of the transistors T56 and T57 commonly receive the pull-down control signal P2[n]. In other embodiments of the invention, the voltage regulator 440 may only include a single transistor. Actually, one or a plurality of transistors connected in series may be configured in the voltage regulator 440, and the number of the transistors is not limited by the invention. Through the circuit framework of connecting a plurality of the transistors in series, a current leakage phenomenon between nodes is mitigated.

The reset circuit 460 is coupled to the pull-down control end PDE2, and provides a reset signal RST to adjust the pull-down control signal P2[n] according to the reset signal RST. The reset circuit 460 includes a transistor T58, where a control terminal of the transistor T58 is coupled to a first terminal of the transistor T58 to form a diode configuration. In the embodiment, a cathode of the diode constructed by the transistor T58 is coupled to the pull-down control end PDE2, and an anode thereof receives the reset signal RST.

Figure 5:
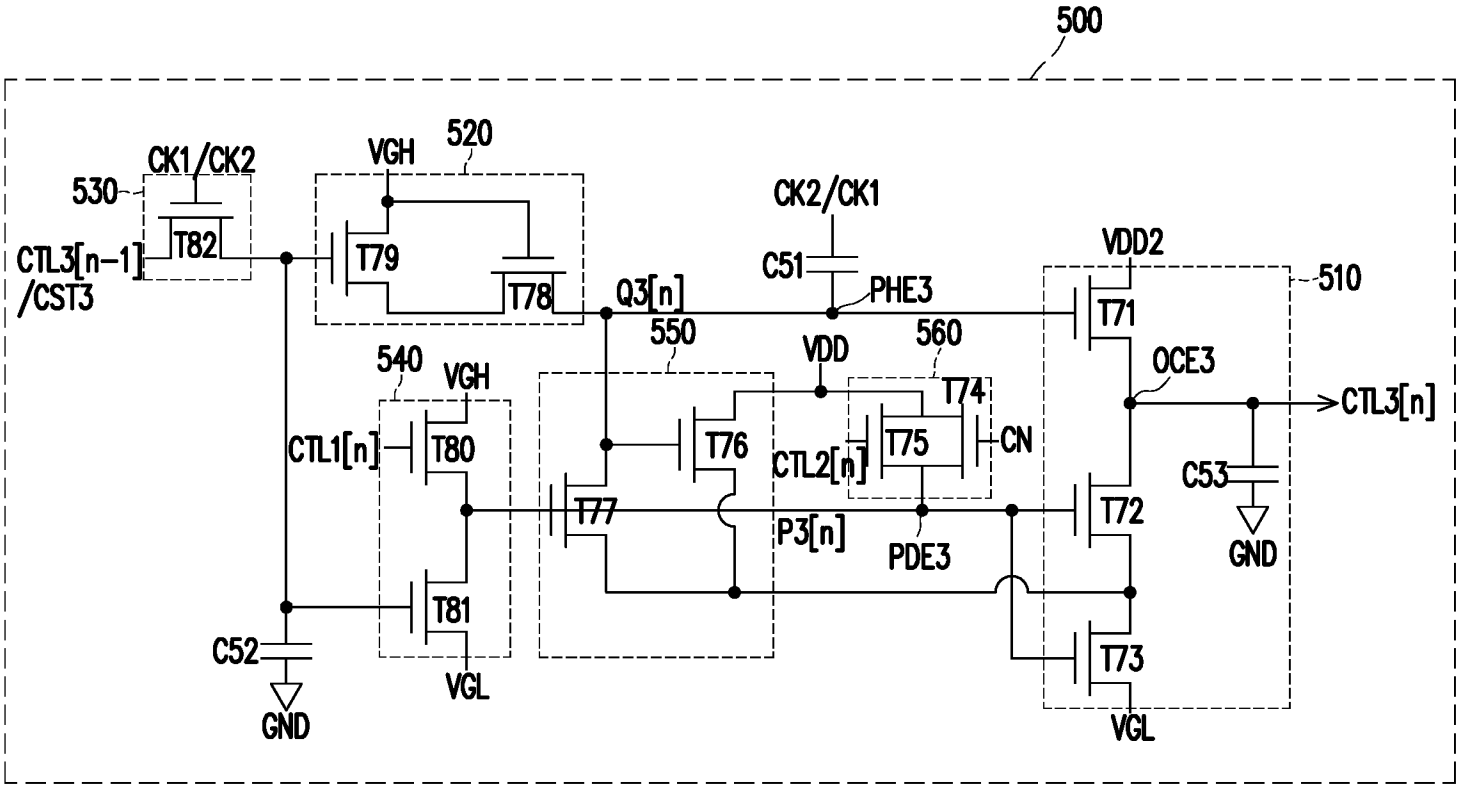
FIG. 5 is a schematic diagram of a circuit framework of a third control signal generating circuit according to an embodiment of the invention.

Referring to FIG. 5, FIG. 5 is a schematic diagram of a circuit framework of a third control signal generating circuit according to an embodiment of the invention. In the embodiment, the control signal generator of the display apparatus has n third control signal generating circuits, where the third control signal generating circuit 500 of the $n^{th}$ stage includes an output stage circuit 510, a voltage regulator 520, a voltage regulator 530, a voltage regulator 540, a voltage regulator 550, a capacitor C51 and a capacitor C52.

The output stage circuit 510 has a pull-high control end PHE3 and a pull-down control end PDE3 to respectively receive a pull-high control signal Q3[n] and a pull-down control signal P3[n], and provides a power voltage VDD2 or the gate low voltage VGL to charge a control output end OCE3 according to the pull-high control signal Q3[n] and the pull-down control signal P3[n], so as to generate a third control signal CTL3[n]. In the embodiment, the output stage circuit 510 includes transistors T71, T72, T73 and a capacitor C53. A first terminal of the transistor T71 receives the power voltage VDD2, a control terminal of the transistor T71 receives the pull-high control signal Q3[n], and a second terminal of the transistor T71 is coupled to the control output terminal OCE3; a first terminal of the transistor T72 is coupled to the control output terminal OCE3, a control terminal of the transistor T72 receives the pull-down control signal P3[n], and a second terminal of the transistor T72 is coupled to a first terminal of the transistor T73; a control terminal of the transistor T73 receives the pull-down control signal P3[n], and a second terminal of the transistor T53 receives the gate low voltage VGL. A first end of the capacitor C53 is coupled to the control output terminal OCE3, and another terminal thereof is coupled to the ground voltage GND. Moreover, one end of the capacitor C51 is coupled to the pull-high control end PHE3, and another end thereof receives the clock signal CK1 and the clock signal CK2.

The voltage regulator 530 is coupled to the voltage regulator 520, and provides a start pulse signal CST3 or the previous-stage third control signal CTL3[n−1] to set the voltage regulator 520 according to the clock signal CK1 and the clock signal CK2. In the embodiment, the voltage regulator 530 includes a transistor T82, where a first terminal of the transistor T82 receives the start pulse signal CST3 or the previous-stage third control signal CTL3[n−1], a second terminal of the transistor T82 is coupled to the voltage regulator 520, and a control terminal of the transistor T82 receives the clock signal CK1 and the clock signal CK2. It should be noted that the number of transistors included in the voltage regulator 530 may be one or plural. The drawing of FIG. 5 is only an example, which is not used for limiting the scope of the invention.

It should be noted that the voltage regulator 530 may receive the start pulse signal CST3 or receive the previous-stage third control signal CTL3[n−1]. The voltage regulator 530 may determine to receive the start pulse signal CST3 or the previous-stage third control signal CTL3[n−1] according to a position of the corresponding third control signal generating circuit. In brief, when the voltage regulator 530 belongs to the third control signal generating circuit of the first stage, the voltage regulator 530 may receive the start pulse signal CST3, and when the voltage regulator 530 does not belong to the third control signal generating circuit of the first stage, the voltage regulator 530 may receive the previous-stage third control signal CTL3[n−1].

The voltage regulator 520 is coupled to the pull-high control end PHE3, and provides the gate high voltage VGH to adjust the pull-high control signal Q3[n] according to the start pulse signal CST3 or the previous-stage third control signal CTL3[n−1] transmitted by the voltage regulator 530. In the embodiment, the voltage regulator 520 includes transistors T78, T79, where a first terminal of the transistor T78 is coupled to a second terminal of the transistor T79, a second terminal of the transistor T78 is coupled to the pull-high control end PHE3, and a control terminal of the transistor T78 receives the gate high voltage VGH. A first terminal of the transistor T79 receives the gate high voltage VGH, the second terminal of the transistor T79 is coupled to the first terminal of the transistor T78, and a control terminal of the transistor T79 receives the start pulse signal CST3 or the previous-stage third control signal CTL3[n−1].

The voltage regulator 540 is coupled between the pull-down control end PDE3 and the voltage regulator 530. The voltage regulator 540 provides the gate high voltage VGH or the gate low voltage VGL to adjust the pull-down control signal P3[n] according to the first control signal CTL1[n], the start pulse signal CST3 or the previous-stage third control signal CTL3[n−1]. In the embodiment, the voltage regulator 540 includes transistors T80 and T81, where a first terminal of the transistor T80 receives the gate high voltage VGH, a control terminal of the transistor T80 receives the first control signal CTL1[n], and a second terminal of the transistor T80 is coupled to the pull-down control end PDE3. A first terminal of the transistor T81 is coupled to the pull-down control end PDE3, a control terminal of the transistor T81 receives the start pulse signal CST3 or the previous-stage third control signal CTL3[n−1], and a second terminal of the transistor T81 receives the gate low voltage VGL. Moreover, a first end of the capacitor C52 is coupled to the control terminal of the transistor T81, and another end of the capacitor C52 is coupled to the ground voltage GND.

The voltage regulator 550 is coupled between the pull-high control end PHE3 and the output stage circuit 510, and provides the pull-high control signal Q3[n] or the power voltage VDD to the output stage circuit 510 according to the pull-down control signal P3[n] and the pull-high control signal Q3[n]. In the embodiment, the voltage regulator 550 includes transistors T76 and T77, where a first terminal of the transistor T76 receives the power voltage VDD, a control terminal of the transistor T76 receives the pull-high control signal Q3[n], and a second terminal of the transistor T76 is coupled to the first terminal of the transistor T73 in the output stage circuit 510. A first terminal of the transistor T77 is coupled to the pull-high control end PHE3, a control terminal of the transistor T77 receives the pull-down control signal P3[n], and a second terminal of the transistor T77 is coupled to the second terminal of the transistor T76.

The voltage regulator 560 is coupled to the pull-down control end PDE3, and provides the power voltage VDD to adjust the pull-down control signal P3[n] according to the second control signal CTL[2] or the first mode selection signal CN. In the embodiment, the voltage regulator 560 includes transistors T74 and T75, where a first terminal of the transistor T74 is coupled to a first terminal of the transistor T75, a control terminal of the transistor T74 receives the first mode selection signal CN, and a second terminal of the transistor T74 is coupled to a second terminal of the transistor T75. The first terminal of the transistor T75 receives the power voltage VDD, a control terminal of the transistor T75 receives the second control signal CTL[2], and the second terminal of the transistor T75 is coupled to the pull-down control end PDE3.

It should be noted that a circuit operation method and a signal waveform of the third control signal generating circuit are similar to that of the aforementioned first control signal generating circuit 300, and details thereof are not repeated.

In summary, a plurality of common voltage generators are respectively used for providing a plurality of common voltages to a plurality of pixel regions in the display panel, so that each of the common voltage generators respectively maintains each of the common voltages at five different voltages in different time intervals in the first polarity driving period and the second polarity driving period in the narrow view mode of the display apparatus. In this way, the display panel produces an all-black display image, so as to achieve the effect that the display apparatus has the display image blackening function. Moreover, in the embodiments of the invention, by respectively providing different charging signals and different reverse charging signals to a first part of the common voltage selection circuits and a second part of the common voltage selection circuits, the first part of the common voltage selection circuits and the second part of the common voltage selection circuits may respectively generate a plurality of common voltages by using different charging signals, so as to achieve an effect of simplifying an overall circuit structure of the common voltage generator.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display apparatus, comprising:

a display panel, having a plurality of pixel regions; and a plurality of common voltage generators, coupled to the pixel regions respectively, and configured to generate a plurality of common voltages respectively, wherein each of the common voltage generators respectively maintains each of the common voltages at a first voltage, a second voltage and a third voltage in a plurality of first time intervals in a first polarity driving period, and respectively maintains each of the common voltages at a fifth voltage, a fourth voltage and the third voltage in a plurality of second time intervals in a second polarity driving period in a narrow view mode, wherein a first polarity of the first and the second voltages in the first polarity driving period is different from a second polarity of the fifth and the fourth voltages in the second polarity driving period, and the third voltage is zero, wherein in the narrow view mode, the first voltage>the second voltage>the third voltage>the fourth voltage>the fifth voltage.

2. The display apparatus as claimed in claim 1, wherein in a fast response mode of the display apparatus, each of the common voltage generators respectively maintains each of the common voltages at the first voltage and the third voltage in the first time intervals in the first polarity driving period, and respectively maintains each of the common voltages at the fifth voltage and the third voltage in the second time intervals in the second polarity driving period.

3. The display apparatus as claimed in claim 2, wherein in the fast response mode, when each of the common voltages is equal to the third voltage, the pixel region corresponding to each of the common voltages executes a data writing operation.

4. The display apparatus as claimed in claim 1, wherein in a normal display mode of the display apparatus, each of the common voltage generators respectively maintains each of the common voltages at the third voltage in the first time intervals in the first polarity driving period, and respectively maintains each of the common voltages at the third voltage in the second time intervals in the second polarity driving period.

5. The display apparatus as claimed in claim 1, wherein in the narrow view mode, when each of the common voltages is equal to the second voltage, and when each of the common voltages is equal to the fourth voltage, the pixel region corresponding to each of the common voltages executes a data writing operation.

6. The display apparatus as claimed in claim 1, wherein the display apparatus is switched between the narrow view mode, a fast response mode and a normal display mode according to an input command.

7. The display apparatus as claimed in claim 1, wherein an absolute value of the first voltage is equal to an absolute value of the fifth voltage, and an absolute value of the second voltage is equal to an absolute value of the fourth voltage.

8. The display apparatus as claimed in claim 1, wherein the adjacent common voltages have a time shift there between.

9. The display apparatus as claimed in claim 1, wherein in the narrow view mode, the common voltages comprise a plurality of common voltage pairs, each of the common voltage pairs comprises a first common voltage and a second common voltage, and the first common voltage and the second common voltage are complementary.

10. The display apparatus as claimed in claim 9, wherein each of the common voltage generators comprises:

a common voltage selection circuit, coupled to a control signal generator, and selecting a first charging signal, a second charging signal, a third charging signal or a fourth charging signal to charge a first output end according to a first control signal, a second control signal and a third control signal, so as to generate the first common voltage, and selecting a first reverse charging signal, a second reverse charging signal, a third reverse charging signal or the fourth charging signal to charge a second output end according to the first control signal, the second control signal and the third control signal, so as to generate the second common voltage.

11. The display apparatus as claimed in claim 10, wherein the first charging signal and the first reverse charging signal are transited between the second voltage and the fourth voltage, the second charging signal, the third charging signal, the second reverse charging signal and the third reverse charging signal are transited between the first voltage and the fifth voltage, and a voltage value of the fourth charging signal is equal to the third voltage.

12. The display apparatus as claimed in claim 11, wherein the common voltage selection circuit comprises:

a first voltage selector, providing the second charging signal or the third charging signal to the first output end according to the first control signal, and providing the second reverse charging signal or the third reverse charging signal to the second output end;

a second voltage selector, coupled to the first voltage selector, and providing the first charging signal to the first output end according to the second control signal, and providing the first reverse charging signal to the second output end;

a transmission gate, coupled between the first voltage selector and the second voltage selector, and providing the fourth charging signal to the first output end according to the third control signal or a first mode selection signal; and a second transmission gate, coupled between the first voltage selector and the second voltage selector, and providing the fourth charging signal to the second output end according to the third control signal or the first mode selection signal.

13. The display apparatus as claimed in claim 10, wherein the control signal generator comprises:

a plurality of first control signal generating circuits, the first control signal generating circuits being coupled in series with each other, wherein the first control signal generating circuit of an nth stage is configured to generate the first control signal;

a plurality of second control signal generating circuits, the second control signal generating circuits being coupled in series with each other, wherein the second control signal generating circuit of an nth stage is configured to generate the second control signal; and a plurality of third control signal generating circuits, the third control signal generating circuits being coupled in series with each other, wherein the third control signal generating circuit of an nth stage is configured to generate the third control signal, wherein n is a positive integer.

14. The display apparatus as claimed in claim 13, wherein each of the first control signal generating circuits comprises:

an output stage circuit, having a first pull-high control end and a first pull-down control end to respectively receive a first pull-high control signal and a first pull-down control signal, and providing a first power voltage or a gate low voltage to charge a first control output end according to the first pull-high control signal and the first pull-down control signal, so as to generate the first control signal;

a first voltage regulator, coupled to the first pull-high control end, and providing a gate high voltage to adjust the first pull-high control signal according to a previous-stage first control signal or a first start pulse signal;

a second voltage regulator, coupled to the first voltage regulator, and providing the previous-stage first control signal or the first start pulse signal to set the first voltage regulator according to a first clock signal or a second clock signal;

a third voltage regulator, coupled between the first pull-down control end and the second voltage regulator, and providing the gate high voltage or the gate low voltage to adjust the first pull-down control signal according to the third control signal, the previous-stage first control signal or the first start pulse signal;

a fourth voltage regulator, coupled between the first pull-high control end and the output stage circuit, and providing the first pull-high control signal or a second power voltage to the output stage circuit according to the first pull-down control signal or the first pull-high control signal;

a fifth voltage regulator, coupled to the first pull-down control end, and providing the second power voltage to adjust the first pull-down control signal according to the second control signal or a first mode selection signal; and a first capacitor, having one end coupled to the first pull-high control end, and another end receiving the first clock signal and the second clock signal.

15. The display apparatus as claimed in claim 13, wherein each of the second control signal generating circuits comprises:

an output stage circuit, having a first pull-high control end and a first pull-down control end to respectively receive a first pull-high control signal and a first pull-down control signal, and providing a second clock signal and a reference voltage to charge a second control output end to generate the second control signal according to the first pull-high control signal and the first pull-down control signal;

an isolation circuit, coupled between the first pull-high control end and a second pull-high control end, and connecting the first pull-high control end and the second pull-high control end according to a gate high voltage, and transmitting a second pull-high control signal to serve as the first pull-high control signal;

a first voltage regulator, coupled to the second pull-high control end, and providing a first scan voltage or a second scan voltage to adjust the second pull-high control signal according to a post-stage second control signal, a second start pulse signal or a previous-stage second control signal;

a second voltage regulator, coupled between the second pull-high control end and the first pull-down control end, and providing the reference voltage or the gate high voltage to adjust the first pull-down control signal according to the second pull-high control signal or a first reverse clock signal;

a third voltage regulator, coupled between the first pull-down control end and the reference voltage, and providing the reference voltage to adjust the second pull-high control signal according to the first pull-down control signal;

a reset circuit, coupled to the first pull-down control end, and providing a reset signal to adjust the first pull-down control signal according to the reset signal.

16. The display apparatus as claimed in claim 13, wherein each of the third control signal generating circuits comprises:

an output stage circuit, having a first pull-high control end and a first pull-down control end to respectively receive a first pull-high control signal and a first pull-down control signal, and providing a first power voltage or a gate low voltage to charge a third control output end according to the first pull-high control signal and the first pull-down control signal, so as to generate the third control signal;

a first voltage regulator, coupled to the first pull-high control end, and providing a gate high voltage to adjust the first pull-high control signal according to a previous-stage third control signal or a third start pulse signal;

a second voltage regulator, coupled to the first voltage regulator, and providing the previous-stage third control signal or the third start pulse signal to set the first voltage regulator according to a first clock signal or a second clock signal;

a third voltage regulator, coupled between the first pull-down control end and the second voltage regulator, and providing the gate high voltage or the gate low voltage to adjust the first pull-down control signal according to the first control signal, the previous-stage third control signal or the third start pulse signal;

a fourth voltage regulator, coupled between the first pull-high control end and the output stage circuit, and providing the first pull-high control signal or a second power voltage to the output stage circuit according to the first pull-down control signal or the first pull-high control signal;

a fifth voltage regulator, coupled to the first pull-down control end, and providing the second power voltage to adjust the first pull-down control signal according to the second control signal or a first mode selection signal; and a first capacitor, having one end coupled to the first pull-high control end, and another end receiving the first clock signal and the second clock signal.

* * * * *